US008122999B2

(12) United States Patent
Guillermety

(10) Patent No.: US 8,122,999 B2
(45) Date of Patent: Feb. 28, 2012

(54) MULTISTORY BUILDING FAST ESCAPE AND RESCUE DEVICE

(76) Inventor: Manuel Iván Guillermety, Guaynabo, PR (US)

( * ) Notice: Subject to any disclaimer, the term of this patent is extended or adjusted under 35 U.S.C. 154(b) by 0 days.

(21) Appl. No.: 12/755,208

(22) Filed: Apr. 6, 2010

(65) Prior Publication Data

US 2010/0193289 A1 Aug. 5, 2010

Related U.S. Application Data

(63) Continuation-in-part of application No. 11/313,059, filed on Dec. 19, 2005, now abandoned.

(51) Int. Cl.
*A62B 1/20* (2006.01)

(52) U.S. Cl. ..... 182/48; 182/49; 182/71; 187/239; 187/240; 187/273; 187/275; 187/277; 193/2 R; 193/25 R; 193/25 E; 193/32; 193/33; 472/49; 472/50; 472/131; 472/133

(58) Field of Classification Search ..... 182/49, 182/48, 71; 187/239, 273, 275, 277; 193/2 R, 193/25 R, 25 E, 32, 33, 34; 472/50, 131, 472/133, 49
See application file for complete search history.

(56) References Cited

U.S. PATENT DOCUMENTS

| | | | | | |
|---|---|---|---|---|---|
| 355,697 | A | * | 1/1887 | Mabbs | 187/273 |
| 2,229,201 | A | * | 1/1941 | Williford et al. | 472/50 |
| 2,374,627 | A | * | 4/1945 | Strong | 244/142 |
| 2,486,036 | A | | 10/1949 | Lacon | 292/146 |
| 2,801,605 | A | | 8/1957 | Hoke, Jr. | 114/324 |
| 3,484,953 | A | * | 12/1969 | Norheim, Jr. | 434/258 |
| 3,916,566 | A | | 11/1975 | Lacombe | 49/7 |
| 3,949,953 | A | * | 4/1976 | Hopkins | 406/185 |
| 3,973,644 | A | | 8/1976 | Zephinie | 182/47 |
| 3,977,495 | A | | 8/1976 | Zephinie | 182/48 |
| 4,005,762 | A | | 2/1977 | Zephinie | 182/48 |
| 4,162,717 | A | | 7/1979 | Orii et al. | 182/48 |
| 4,174,711 | A | | 11/1979 | Laing et al. | 128/204.18 |
| 4,220,278 | A | | 9/1980 | Hasselbring | 232/35 |
| 4,264,311 | A | * | 4/1981 | Call et al. | 434/247 |
| 4,372,423 | A | | 2/1983 | Pelley | |
| 4,531,611 | A | | 7/1985 | Curiel | 182/44 |
| 4,592,270 | A | | 6/1986 | Vener | 454/68 |
| 4,706,551 | A | | 11/1987 | Schofield | 454/66 |
| 4,922,806 | A | | 5/1990 | Newman et al. | 454/195 |
| 4,997,060 | A | | 3/1991 | Sassak | 182/48 |
| 5,074,897 | A | | 12/1991 | Sikich | 55/385.2 |
| 5,417,615 | A | * | 5/1995 | Beard | 472/50 |
| 5,447,211 | A | | 9/1995 | Sors | 187/277 |

(Continued)

*Primary Examiner* — Alvin Chin Shue
*Assistant Examiner* — Colleen M Quinn
(74) *Attorney, Agent, or Firm* — Browdy and Neimark, PLLC

(57) ABSTRACT

An escape and rescue device used in a multistory building during a terrorist threat or a fire to: a) evacuate a person or persons attached to an expandable disc support with an attachment that is lowered from an upper level of a building through a vertical tube, by using a lesser pressure at the top of the tube and a higher pressure at the bottom of the tube, using a door at the top or a door at the bottom to maintain pressure or by artificial air pressure, thereby permitting the fast evacuation of many people in a short time, b) it can be used by firemen in training in its use and benefits, c) also at amusement parks, where there would be a ride that would teach the users about its reliability and safety, and d) to transport firemen in a fast way from the ground to the upper floors without interfering with the evacuation in process at the congested stairways of the building.

11 Claims, 18 Drawing Sheets

U.S. PATENT DOCUMENTS

| | | | | |
|---|---|---|---|---|
| 5,583,326 | A | 12/1996 | Sors | 187/277 |
| 5,597,358 | A | 1/1997 | Marcu | |
| 5,607,103 | A | 3/1997 | Boling, Jr. | 232/17 |
| 5,655,909 | A | 8/1997 | Kitchen et al. | 434/44 |
| 5,980,164 | A | 11/1999 | Fratello | 406/190 |
| 6,085,873 | A | 7/2000 | Macchi | 187/273 |
| 6,808,047 | B2 | 10/2004 | Takeshima | 182/70 |
| 6,817,443 | B1 | 11/2004 | Metz | 182/82 |
| 7,188,705 | B1 | 3/2007 | Fuhrmann | |
| 2003/0116380 | A1 | 6/2003 | Xia et al. | |

* cited by examiner 71
783
17
79
37
22
75
27

71
17
37
22
75
40
27
46

71
79
33
17
37
22
40
27
46

71
79
17
33
37
34
22
75
40
27
46
806
46
806
77

71
41
34
22
75
79
37
17
72
40
27
79
37
17
46
80
810
61
71
80
46
810
42
37
79
17
32
77
71

MULTISTORY BUILDING FAST ESCAPE AND RESCUE DEVICE

BACKGROUND OF THE INVENTION

1. Field of Invention

This invention is related to the evacuation from buildings that are three or more stories high in a fast and continuous method where a person fixed to a harness and hanging on a disc support is lowered to safety through a tube using a lesser pressure at the top of the tube and a higher pressure at the bottom of the tube. Also, its use is intended to also send firefighters and rescue persons upward to the upper floors to rescue persons that need help during a terrorist attack or a fire.

2. Prior Art

After the 9-11 Twin Towers tragedy in New York and other catastrophes on buildings where human lives were lost, I decided to find a way to innovate the very obsolete ways of dealing with a fire in buildings where many persons would be defenseless and could not escape.

It was necessary to find a better way of evacuating people from buildings on fire with better equipment than is currently available in the market. At the time of the incident at the World Trade Center, it was also noticeable that the firefighters had an almost impossible task of getting to the upper levels because they had to use the same stairwell going up that the escapees were using going down to escape from the building.

In the early years of firemen and fire trucks, the best way to save persons in distress was by lowering them using a ladder that the fire engine truck had when it arrived to the site, where the fireman had to sometimes risk his own life to get these people down the ladder. Once the first person was on the ground, the brave fireman would sometimes be subject to deadly smoke inhalation while trying to get back and climb the ladder for a second time to find another person, who perhaps was with a child that would not go down the ladder due to panic. The fireman would have to wait until the child fainted or was calmed to get him down while at the same time other evacuees were waiting for the fireman to arrive to the assigned window of the building on fire to be rescued.

Many had to jump from high places and fall to a rescue device, such as a ring, that sometimes has over 8 men to hold it, abandoning more responsible tasks while in the rescue. The life saving process was slow. It ended in tragedies that added up costing many lives, and only a few would be alive to tell us about the story of the moments of terror that they had lived. The rescue equipment and available firefighter systems have changed very slowly over the years, and every day there is more need for a solution to this condition.

Nowadays the evacuation problem in case of an emergency is broader. With more buildings, and taller and taller buildings being constructed, more and more people are living or working in them than ever before. We have to add the unfortunate burden of having to deal with terrorist, arsonists, and lunatics who are repeatedly thinking of what, where, and when to strike to cause damage. There are occasions in a terrorist attack or fire that when the situation becomes so critical that the people entrapped by the fire or the smoke would finally decide to jump from the roof of the buildings to the ground because they would feel hopeless even knowing that with this action they would end their lives.

There are a number of U.S. patents and publications related to escape devices, but none has the advantages of the present invention.

Studies in areas related to pneumatic tube escape and rescue systems or people escape systems using air pressurized methods also have no similar disclosures as the present invention.

For example, the following patents were investigated thoroughly:

In the present invention, I present a vacuum pressure at the top of the tube or at the top of the disc support where in Pelley U.S. Pat. No. 4,372,423 a vacuum pressure on top of the parachute is not mentioned. The top of the tube in the Pelley system is open and there are no connotations on Pelley's claims that the balloon shaped parachute requires a vacuum pressure on its top, nor is it understood by looking at the Pelley patent. I understand that my invention does not conflict with the idea present in the Pelley patent.

In Marcu (U.S. Pat. No. 5,597,358) no vacuum pressure is mentioned or implied. Since Marcu needs an open top or an opening above the capsule to release the air contained at the upper side of the capsule while going upward with the central capsule valve closed, even though in claim 1 and in the $9^{th}$ paragraph of the 24 paragraphs Marcu mention that he has an adjustable Droseling valve (a flow valve) at the upper part of the tube, this would still not imply having a vacuum pressure in the system. Marcu also has to have the top open to free air when his capsule drops at a free fall speed. In no instance may there be a vacuum pressure in the upper area of the tube in Marcu. This would be a slowing mechanism when Marcu is trying to accelerate. This reasoning is made because in all instances during the climbing of the capsule and the free fall of the capsule, Marcu has to have atmospheric pressure above the capsule in order to have his capsule go up to the highest point before and after the capsule drops on a free fall, which implies that Marcu may not have any type of negative or vacuum pressures in the system, otherwise it would not perform properly. As for the stopping of the capsule at the end of the run, Marcu uses the central valve in the capsule with the desmodromic mechanism (lever actuated valve) in the closed position to decelerate and stop the capsule with positive pressure (Marcu also has a set of springs at the bottom to have an additional mechanical way of stopping the capsule in case there is a mishap if the valve does not close properly). Therefore at all times the capsule is controlled with a positive pressure. Marcu also mentions the Droselling valve that is placed from the inside to the outside at the bottom of the tube where this valve is used to release the positive pressure when bringing the capsule to a stop. This mechanism is not similar to the present invention, especially because the invention that Marcu discloses is not related to escape devices.

On the contrary, the vacuum and/or negative pressures are pertinent to the present invention and are not known to have been mentioned before in prior inventions. The stopping of the present invention with a vacuum pressure for an escape device is a novelty and these are not implied in the Marcu system.

Another fact about the Marcu system is that the valves, being a Desmodromic valve or a Droselling valve, are variable valves and in the present invention the holes and/or preset valves are intended to stay open (not variable) due to the care that must be exerted due to the fact that the present invention deals with the fall of live persons. The present invention shows that there is an optimum pattern in the preset valve arrangement, the amount of preset valves or holes, the sequence and location of these preset valves on the length of the tube.

Fuhrmann (U.S. Pat. No. 7,188,705) is a patent related to an escape system consisting of a cup that falls through a tube controlled by a positive pressure exerted below the cup formed escape device. It defers from the present invention in various ways. First, Fuhrmann forms a cup where a person is sitting in the cups base, whereas the present invention has a disc support that is placed at the top of the escapee. Second, the decelerating mechanism on the Fuhrmann system is created by reducing the width of the tube at several consecutive intervals thus reducing the diameter of the tube and controlling the escape of the air flow. In the present invention, however, the air is dissipated by an arrangement of holes or preset valves that are placed from the inside to the outside of the tube. Third, the fall control of the Fuhrmann invention is obtained by two iris valves placed in the pathway of the tube one after the other, where in the present invention acceleration/deceleration is exerted by a vacuum pressure above the disc support, or a pressure difference between the upper and lower side of the disc support, without a valve in the cross section of the tube. Fourth, the Fuhrmann invention slows down due to a positive pressure below the cup whereas in the present invention for the escapees the acceleration and the deceleration are controlled through a vacuum pressure.

Xia (U.S. Publication No. 20030116380) uses forced air induced in the descent of escapees. The jets of Xia have an exterior pressure of high inward free air pressure of over 1.5 psi to 6 psi in pressure. Xia uses a powerful jet to stop the persons from falling at the end of the tube, which could be dangerous. To obtain control of a falling object that measures basically 200 square inches on a very tight tube, as in Xia, would need at least 6 psi (pound per square inch) of air. The turbine would have to be very big as this type of free air flow at 6 psi would have a large loss. Falling through a duct with a direct flow of air while avoiding from being hit against the ground floor is believed to be impractical.

SUMMARY

The present invention is to be used during a terrorist threat or a fire as a fast fire escape and a rescue device to remove people from a multistory building. This mechanism is easy to use and has fast evacuation results. In fact, it may be used immediately after the notion of the fire is known. There is no intervention of outside personnel or Firemen personnel. The invention includes a disc support attached to a strapped harness which is fixed to a person, where this disc support slides through a tube generating a lower pressure at the top thereof and a higher pressure at the bottom thereof, thus controls the person's descent to safety.

It not only helps the escapee to descend to safety, but it also is a way to send firefighters through the rescue device upward to the upper floors in a fast and safe way. Firefighters would be attached with a harness to the disc support to get through the tube up to the upper floors to help people that are trapped, unconscious or impaired and to help them get down through this system or through another escape device. The firefighters would not need to use the stairways which are used by the stampede of people evacuating the building, which is known to interfere with the firemen trying to get to the upper floors. It is important to realize that being the first minutes of a fire the only time one has to evacuate a building, it is of importance that one may start the evacuation without having to wait for anyone.

An object of the invention is to improve the escape of persons from upper floors of a building in danger, e.g. on fire, by controlled descent through a generally vertical tube, supported by a disc which contacts and slides within the interior of the tube.

BRIEF DESCRIPTION OF THE DRAWINGS

FIGS. 9A-10E show another embodiment of the rescue device where the tube is a foldable double wall duct.

DETAILED DESCRIPTION OF THE INVENTION

Figure 1A:
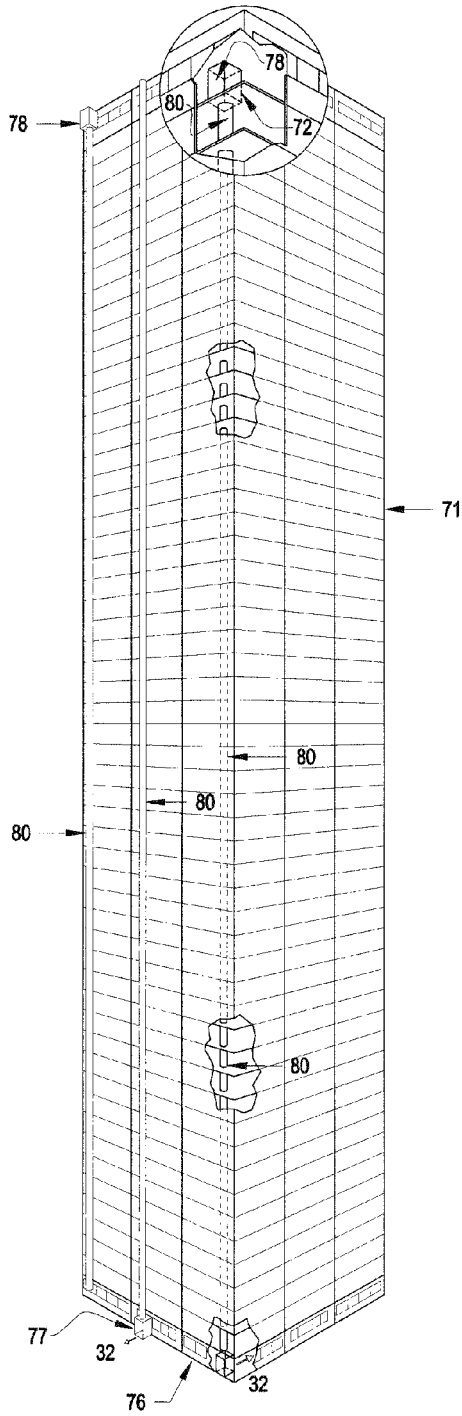
FIG. 1A shows a high rise building having a plurality of escape devices according to the present invention.

Embodiments of the present invention will now be described more fully with reference to the accompanying drawings, in which the embodiments are shown. The present invention may, however, be embodied in many different forms and should not be construed as being limited to the embodiments set forth herein; rather, the embodiments are provided so that this disclosure will be thorough and complete, and will fully convey the concept of the invention to one skilled in the art. In the drawings, the dimensions and regions are exaggerated for clarity. Like reference numerals in the drawings denote like elements, and thus, their description will not be repeated.

Accordingly, while embodiments of the invention are capable of various modifications and alternative forms, only the embodiments thereof are shown by way of example in the drawings and will herein be described in detail. It should be understood, however, that there is no intent to limit embodiments of the invention to the particular forms disclosed, but on the contrary, embodiments of the invention are to cover all modifications, equivalents, and alternatives falling within the scope of the invention. Thus, parts in one drawing may be substituted for parts in other drawings below to thus provide additional variations or embodiments.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of embodiments of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "on" versus "directly on", "between" versus "directly between", "adjacent" versus "directly adjacent", etc.).

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the Figs. For example, two Figs. shown in succession may in fact be executed substantially concurrently or may sometimes be executed in the reverse order, depending upon the functionality/acts involved.

Although the embodiments of the present invention have been disclosed for illustrative purposes, those skilled in the art will appreciate that various modifications, additions and substitutions are possible, without departing from the scope and spirit of the invention as disclosed in the accompanying claims.

Figure 1B:
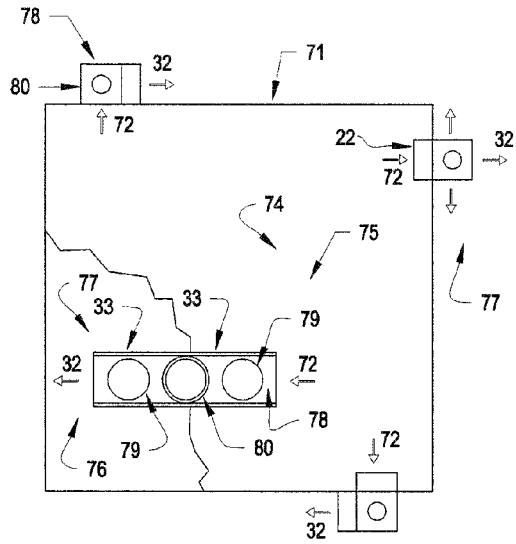
FIG. 1B shows an cross section of the high rise building with an escape device application.

FIG. 1A and FIG. 1B show that when in an emergency due to terrorist threat or a fire on a building, there is a method of fast escape from a building into safety. As is shown on FIG. 1A and FIG. 1B, the building may be three (3) floors to more than 120 stories, and a person may go through an entrance 72 into a cabin 78 at a roof floor 74 or at an upper floor 75, where a vertical tube 80 is connected to a lower floor 76 or to ground floor 77 where an exit 32 is located.

Figure 1C:
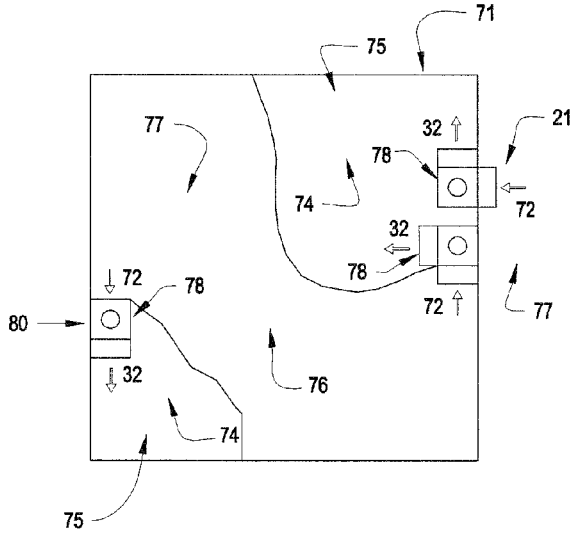
FIG. 1C shows a cross section of the high rise building with a rescue device application.

FIG. 1C shows that when in emergency due to terrorist treats or a fire on a building, there is a method of rescue by firefighters using a positive and a negative air pressure from a blower as to rise themselves through a tube 80 to rescue injured persons 17 located at an upper floor 75. To this end, a firefighter may go through an entrance 72 into a lower chamber 78 on the ground floor 77 or at a lower floor 76, which is connected to the upper floor through the vertical tube 80 and rise to an upper floor 75 or to the roof floor 74, where an exit 32 is located, reaching the place where the firefighter may find entrapped persons waiting to be rescued.

Figure 2A:
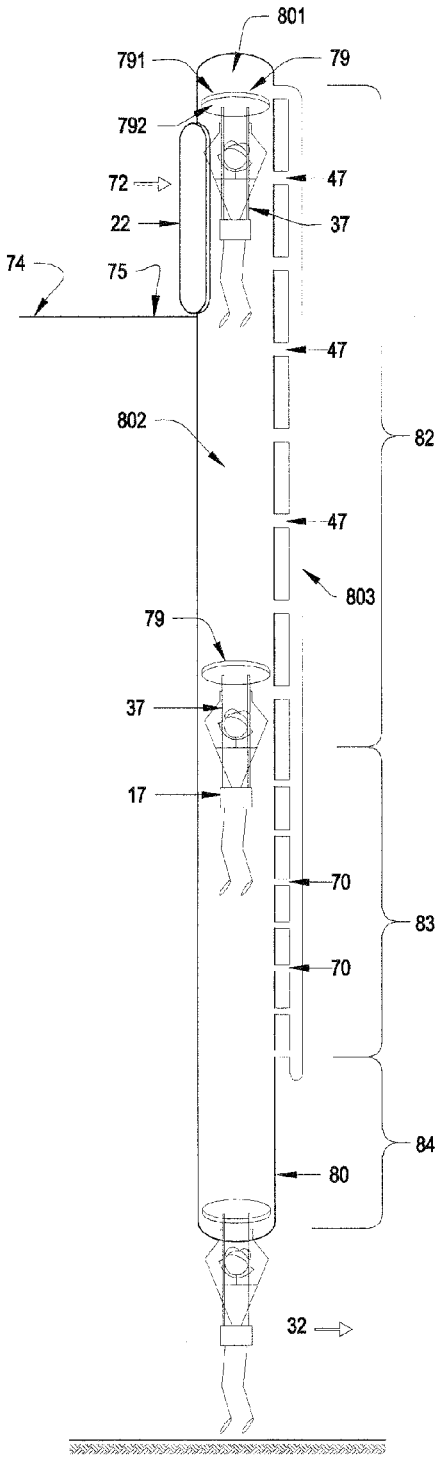
FIG. 2A shows a vacuum and/or negative pressure version of the escape device.

FIG. 2A shows one example embodiment of the escape device. The tube 80 includes a first entrance 72 at the roof floor 74 and an open end at the bottom floor. The tube 80 also includes, from the upper side to the lower side thereof, respectively, a first section 82, a second section 83, and a third section 84. Along the first section 82, there are provided on the wall of the tube 80 a plurality of first holes and/or preset valves 47 distributed along the longitudinal direction of the tube 80. Along the second section 83, there are provided on the wall of the tube 80 a plurality of second holes and/or preset valves 70 distributed along the longitudinal of the tube. There are no holes and/or preset valves along the third section 84.

Each hole and/or preset valve includes a first side connected to the inner space of the tube 80 and a second side parallel connected to the rest of the holes and/or preset valves by an otherwise closed channel 803, so that each hole and/or preset valve is connected to every other holes and/or preset valves. Therefore, air in the tube can circulate from a lower portion of the tube to an upper portion of the tube, or vise versa, through the holes and/or preset valves 47, 70 and the channel 803.

Further, the escape device also includes a disc support 79 having an upper side 791, a lower side 792, and a diameter that matches the inner diameter of the tube 80, so that it is capable of sliding within the tube and which divides the inner space of the tube 80 into two parts: the upper space 801 above the disc support 79 and the lower space 802 below the disc support 79.

To safely escape the building 71, a person 17 who has attached a harness 37 connected to the disk support 79 first enters the tube 80 through the door 22 after passage through the entrance 72 at the roof floor 74 or the upper floor 75, and then hangs himself or herself below the disc support 79 by the harness or attachment 37. The attachment 37 is desirably a four-point harness system including a buckle 38 and a belt 39, where a person 17 can be fixed thereto and rides or slides downwardly against the smooth surface 81 of the tube 80, as shown in FIGS. 3A-3D. Because of the weight of the person and the effects of gravity, he/she will slide downwardly through the vertical tube 80 from the top thereof towards the bottom thereof.

Figure 2B:
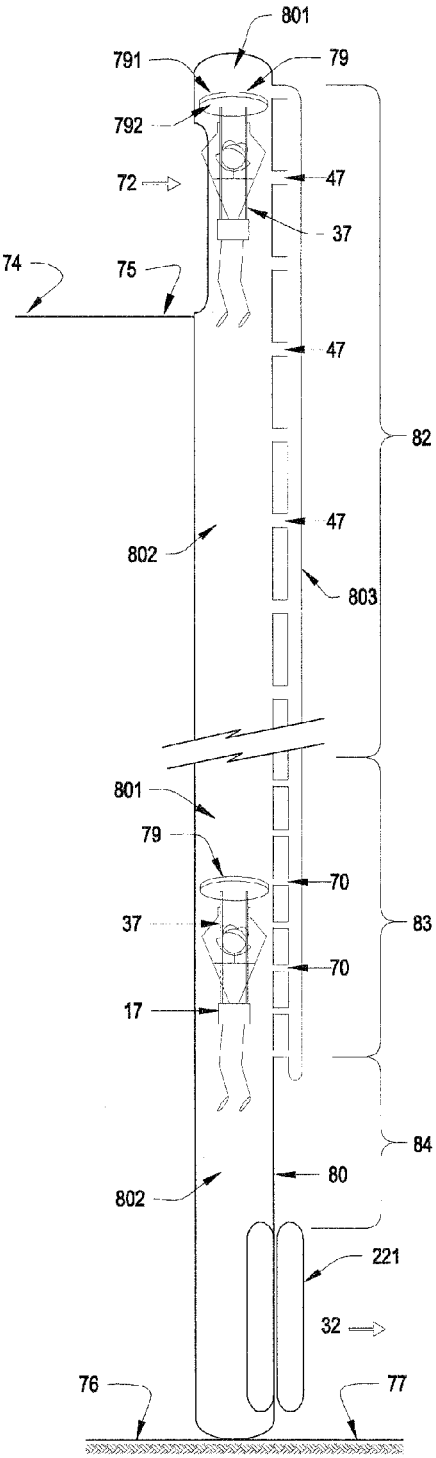
FIG. 2B shows a positive pressure version of the escape device.

The downward motion of the disc support 79 compresses the air in the lower space 802 and increases the volume of the upper space 801, and thus generates an air pressure difference between the upper space 801 and lower space 802. In the event that only the upper space 801 is encapsulated, as shown in FIG. 2A, the motion will decrease the air pressure of the upper space 801 only. The air pressure in the lower space 802 remains at atmosphere pressure. In the event that only the lower space 802 is encapsulated, the motion will increase the air pressure of the lower space 802, but the upper space 801 will remain at atmosphere pressure as shown in FIG. 2B. When both of the upper space 801 and the lower space 802, are encapsulated, the motion will decrease the air pressure of the upper space 801 and increase the air pressure of the lower space 802. In any case, the pressure difference between the lower space 802 and upper space 801 (e.g., 0.4 psi-1.2 psi) generates an upward force on the disc support 79 that counteracts against the weight of the person. That said, the upward force is equivalent to a damping force to the downward motion of the disc support 79.

The amplitude of the upward force positively relates to the amplitude of the pressure difference between the lower space 802 and the upper space 801. In an ideal situation when friction between the disc support 79 and the tube 80 is trivial, if the pressure difference is too small to overcome the weight of the person, the descending motion accelerates, otherwise, when the pressure difference is increased sufficiently so that the upward force is significant compared to that of the weight of the person, his/her descending motion will decelerate.

Driven by the pressure difference, when the disc support 79 is moving in the first section 82 or in the second section 83, the air in the lower space 802 flows to the upper space 801 through the holes and/or preset valves 47, 70. Due to the descending motion of the disc support 79, the volume of the upper space 801 increases constantly and the volume of the lower space 802 decreases constantly. The air exchange between the lower and upper spaces 802, 801 partially compensates the volume change and therefore at least partially offsets the change of the pressure difference between the lower space 802 and the upper space 801.

The extent of such compensation/offset depends on the flux of the air between the upper space 801 and the lower space 802. By distributing the holes and/or preset valves 47, 70 in a predetermined pattern, the flux rate of the valves 47, 70, and the overall flux of the air between the upper space 801 and the lower space 802 can be controlled, so that when the person is traveling through the first section 82 of the tube 80, the descending motion of the disc support 79 creates a predetermined lesser pressure difference, thus a predetermined acceleration to the motion; when the person is traveling through the second section 83 of the tube 80, the motion of the disc support 79 creates a predetermined larger pressure difference, thus a predetermined deceleration to the motion.

As an example, FIG. 2A shows that the holes and/or preset valves 47 in the first section 82 are larger, whereas the holes and/or preset valves 70 in the second section 83 are smaller. Other configurations and distributions for the holes and/or preset valves may also be applied to these sections to achieve the above-mentioned predetermined acceleration arrangement.

When the disc support 79 arrives to the third section 84 of the tube 80, where there are no holes and/or preset valves, no air exchange occurs between the lower space 802 and the upper space 801, and therefore there is no air pressure difference being offset by the air exchange. As a result, the air pressure difference between the upper and lower spaces 801, 802 keeps increasing along with the descending motion of the disc support 79, thus the disc support 79 keeps decelerating, until it reaches the open end of the tube 80 where the lower floor 76 or the ground floor 77 is located, at which place the velocity of the disc support 79 decreases to zero. After landing, the person 17 can then remove the disc support 79 from the tube 80 and release himself/herself from the attachment 37 and proceeds toward the exit 32.

Figure 3A:
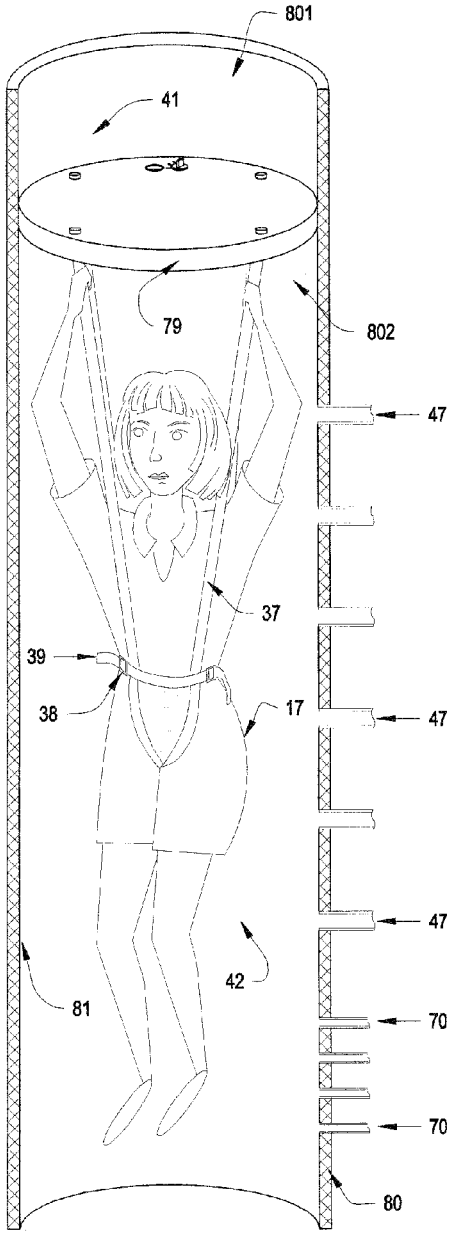
FIG. 3A shows a person fixed to an attachment hanging below a disc support that slides through a tube, according to an embodiment of the escape device shown in FIG. 2A and FIG. 2B.
Figure 3B:
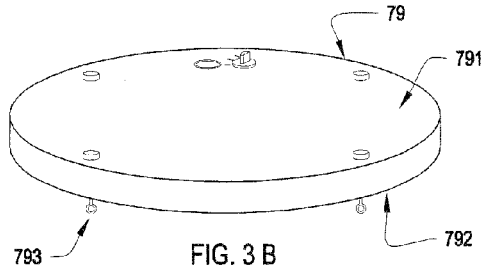
FIG. 3B is a perspective view of an embodiment of the disc support.
Figure 3C:
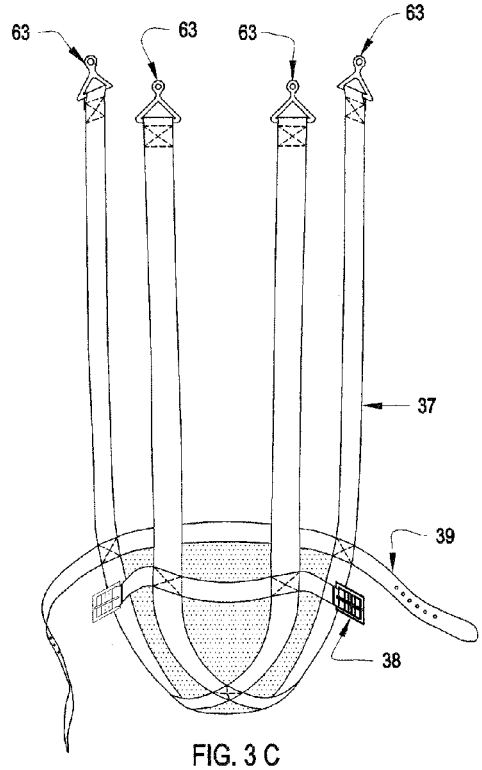
FIG. 3C shows a side view of the attachment.
Figure 3D:
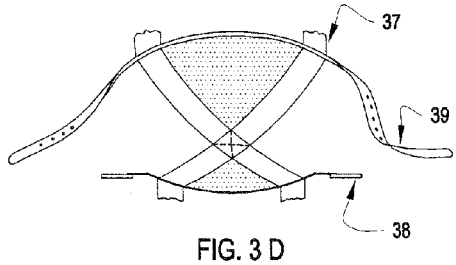
FIG. 3D shows a top view of the attachment.
Figure 4A:
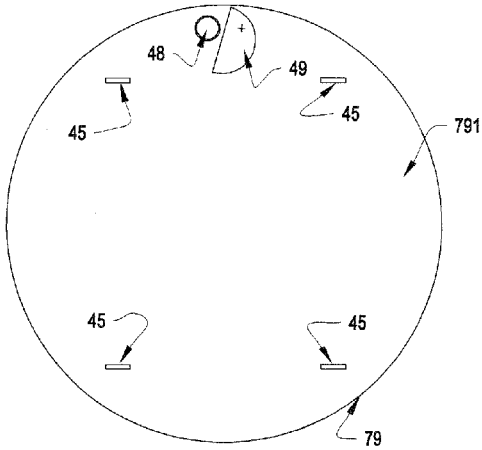
FIG. 4A shows a bottom view of the disc support in FIG. 3B.
Figure 4B:
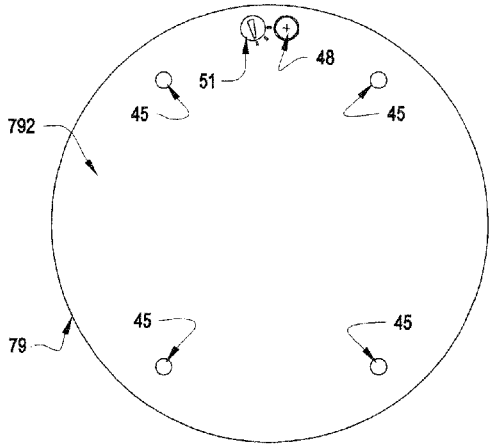
FIG. 4B shows the top view of the disc support in FIG. 3B.
Figure 4C:
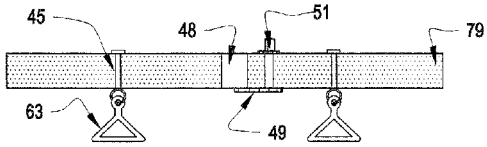
FIG. 4C shows a cross section of the disc support in FIG. 3B.
Figure 4D:
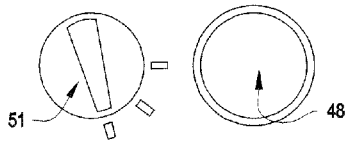
FIG. 4D shows a top view of a hole and a knob in the disc support in FIG. 4B.
Figure 4E:
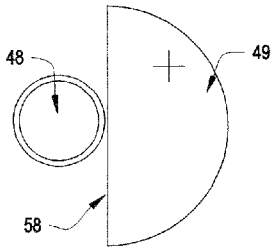
FIG. 4E shows a bottom view of the hole and the valve, where the valve is in an open position.
Figure 4F:
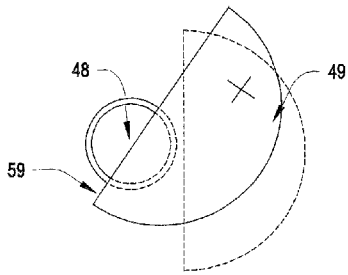
FIG. 4F shows the bottom view of the hole and the valve, where the valve is in a half closed position.
Figure 4G:
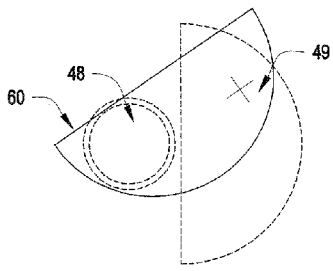
FIG. 4G shows the bottom view of the hole and the valve, where the valve is in a closed position.

Various configurations can be applied to the disc support 79. For example, it may simply be a high profile disc with rings 793 to connect to the attachment 37, as shown in FIG. 3B. It may further include a valve system 48 for speed control, as shown in FIGS. 4A-4G which illustrate an embodiment of the disc support 79, wherein the disc support 79 has a hole 48 and a valve 49 on the lower side 792 to adjust the descending speed of the person 17 corresponding to her weight. Further, on the upper side 791 of the disc support 79, there is also provided with a knob 51 connected to the valve 49 for turning the valve 49 which has three positions, namely closed, semi-closed, and open as shown in FIGS. 4E to 4G. The valve 49 is set at a position according to the weight of the person. The adjustment of the valve adjusts the air flux through the hole 48 when the disc support 79 is moving through the tube 80, and thus adjusts the pressure difference between the upper space 801 and the lower space 802, and accordingly adjusts the acceleration or deceleration of the disc support 79. FIGS. 4A-4G show that the hole 48 locates at the edge of the disc support 79. It can certainly be arranged to other place of the disc support, such as to the center thereof.

FIGS. 16A-16D show another embodiment of the disc support 79. According to the embodiment, the disc support 79 is a two layer structure. It includes a disc 794 and a lower ring 87 connected by two levers 62 and a nonporous flexible skirt 152. The lower ring 87 has an outer diameter substantially being the same as that of the disc 794. The outer skirt 152 connects the outer peripheral of the lower ring 87 with the outer peripheral of the disc 794, so that when the lower ring moves towards or away from the disc 794, i.e., when the disc support 79 is in a closed/open position, the skirt 152 is folded/deployed. Further, the lever 62 is a mechanism with two bars 621, 622. Each bar 621/622 connects to the other bar by a hinge 623 at one side, and connects to either the disc 794 or the lower ring 87 by a hinge 624 at the other side. The lever 62 serves as a skeleton to the folding and deploying of the skirt 152, preventing the skirt 152 from being torn away from the disc 794 or the lower ring 87 when the disc support 79 is opened by a force.

The lever 62 also helps the planar surfaces of the disc 794 and the lower ring 87 face each other when the disc support 79 is closed/opened. When the disc support 79 slides through the tube 80, the planar surfaces of the disc 79 and lower ring 87 remains perpendicular to the longitudinal axis of the vertical tube 80, thus avoiding a turn over of the disc support 79. Such configuration also helps maintain a minimum and/or a predetermined the air pressure loss that occurs between the disc support edges and the interior surface of the tube 80, thus allowing a controlled descending of the disc support and the person supported thereby.

Figure 16A:
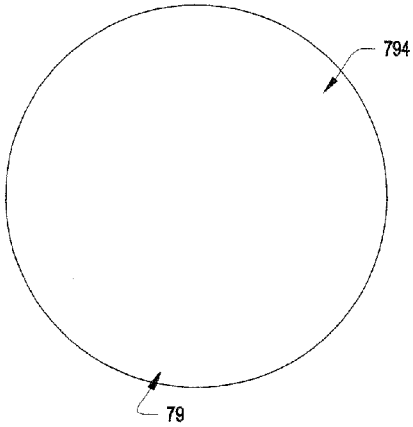
FIG. 16A shows a top view a disc support, according to an embodiment.
Figure 16E:
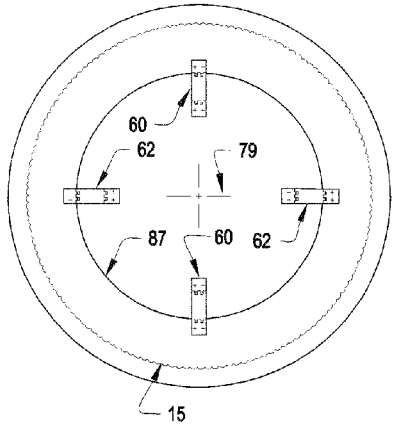
FIG. 16E shows the bottom view of the disc support.
Figure 16B:
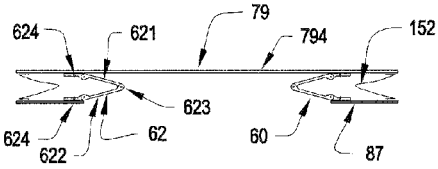
FIG. 16B shows a side view of the disc support in a closed position.
Figure 16C:
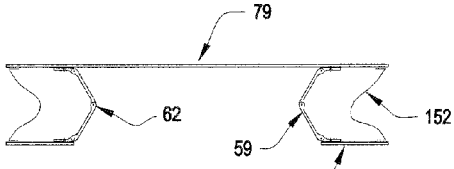
FIG. 16C shows a side view of the disc support in a half closed position.
Figure 16D:
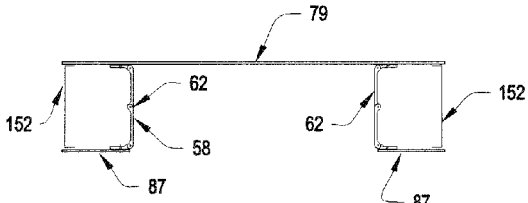
FIG. 16D shows a side view of the disc support in an open position.
Figure 16F:
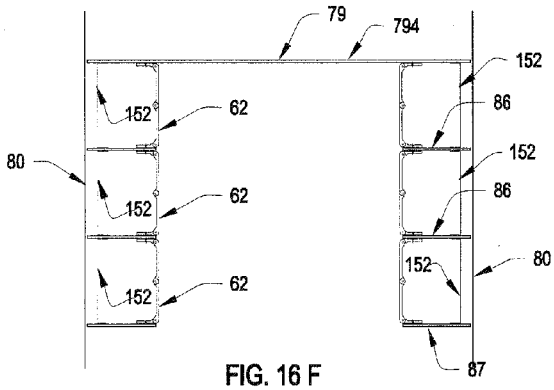
FIG. 16F shows a disc support in a multi ring setup arrangement, according to an embodiment.

The disc support 79 can also have multiple layers of skirts and rings. FIG. 16F shows an embodiment of the multi ring setup arrangement and the person supported thereby.

According to the embodiment shown in FIG. 16F, the disc support includes the disc 794, several intermediate rings 86, and a lower ring 87. The disc 794 and the rings 86, 87 below the disc 794 are connected in series, forming a multiple layer structure. Each layer is connected to another by a lever 62 and a skirt 152 in a similar manner as that of the two layer disc support described above. Such multi-layer structure provides an improved air sealing when the disc support travels through the tube 80. This is because due to mismatch between the tube 80 and the disc support 79, there is always a space, no matter how small it is, between the inner surface 81 of the tube and the outer peripheral of the disc support 79. When there is only one layer, the air only needs to pass through one layer of the space to leak from below the disc support 79 to above the disc support 79. With a multi-layer structure, however, the air has to pass several layers of spaces to leak from below the disc support 79 to above the disc support 79. Each layer of the space increases the difficulty for the leakage, thereby creating a better sealing between the space below the disc support 79 and the space above the disc support 79, thereby providing the disc support 79 better controllability for the descending movement.

Figure 16G:
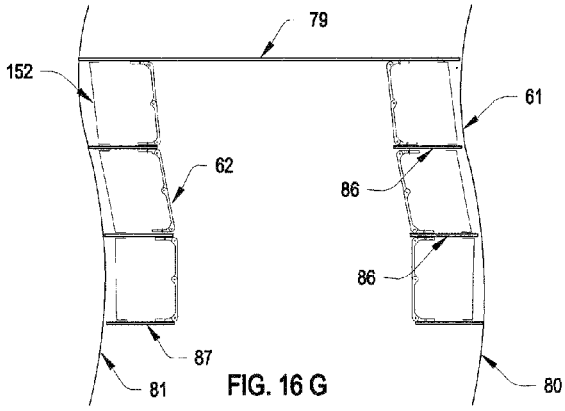
FIG. 16G shows the disc support in a multi ring setup arrangement having a traverse deflection when passing through a deflected tube.
Figure 17A:
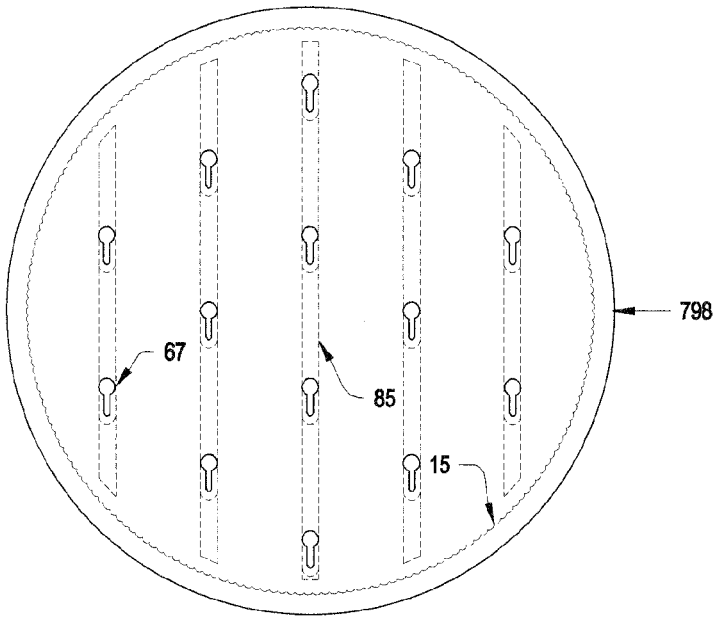
FIG. 17A shows a large disc support for a plurality of persons with the nonporous flexible material and the beam, according to another embodiment.
Figure 17B:
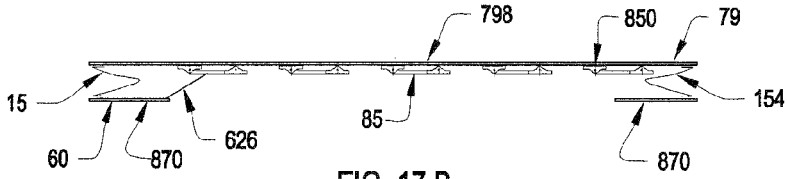
FIG. 17B shows a side view of the large disc support in a closed position.
Figure 17C:
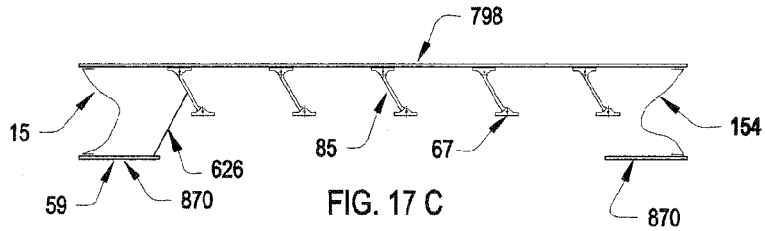
FIG. 17C shows a side view of the large disc support in a half closed position.
Figure 17D:
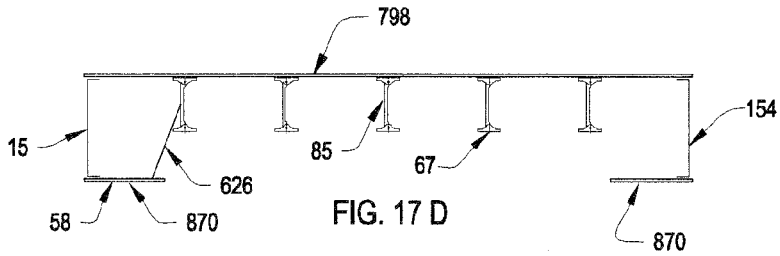
FIG. 17D shows a side view of the large disc support in an open position.
Figure 18A:
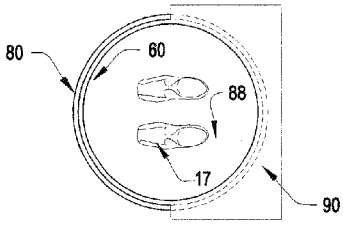
FIG. 18A shows a top view of a person on top of a floor plank in a closed position inside a tube, according to an embodiment.
Figure 18D:
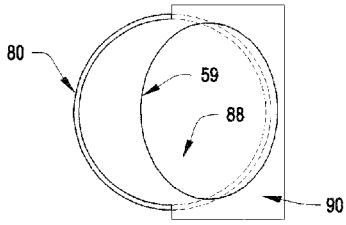
FIG. 18D shows a top view of the floor plank in a half closed position inside the tube.
Figure 18G:
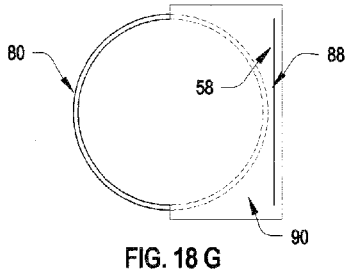
FIG. 18G shows a top view of the floor plank in an open position inside the tube.
Figure 18B:
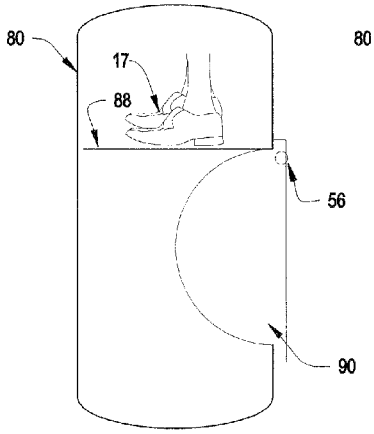
FIG. 18B shows a left side view of the person on top of the floor plank in the closed position inside the tube.
Figure 18E:
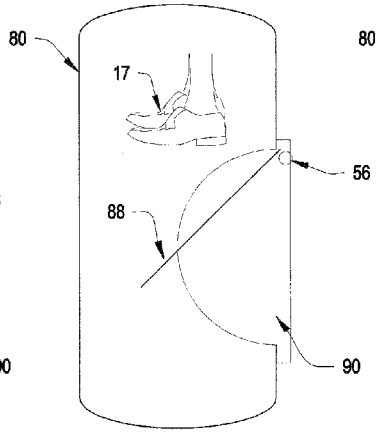
FIG. 18E shows a left side view of the floor plank in the half closed position inside the tube.
Figure 18H:
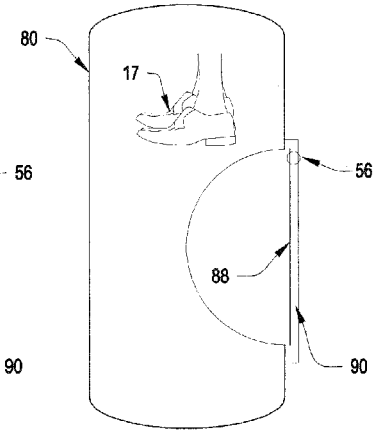
FIG. 18H shows a left side view of the floor plank 88 in the open position inside the tube.
Figure 18C:
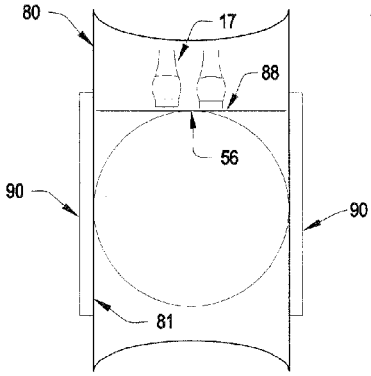
FIG. 18C shows a frontal side view of the person 17 on top of the floor plank in a closed position inside a tube.
Figure 18F:
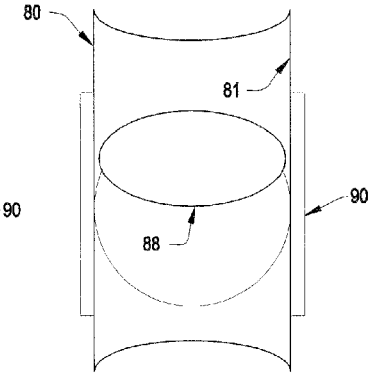
FIG. 18F shows a frontal view of the floor plank in the half closed position inside the tube.
Figure 18I:
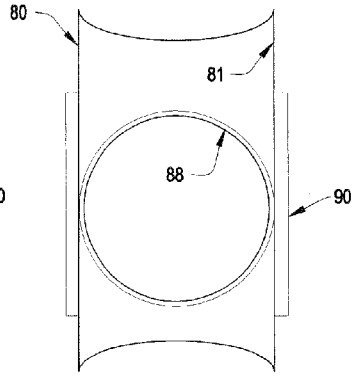
FIG. 18I shows a front view of the floor plank in the open position inside the tube.

The multiple layer structure also provides the disc support 79 with a certain degree of flexibility when moving through the tube 80. As shown in FIG. 16G, when said tube 80 is deflected in a traverse direction, or has minor variation in diameter, symmetry, position, or is off centered or with an imperfect roundness cross section, the multi-layer disc support 79 is capable of deforming in a traverse direction to maintain a good sealing effect between the air above and below it, thus permitting a desired control over the descending motion.

FIGS. 11A-11F show another embodiment of the disc support. According to this embodiment, the disc support is in the form of a ring shaped support 79 slidable against the smooth surface 81 of the tube 80. The ring shaped support 79 connects to an attachment 37 and a pant 55, so that a person 17 can go into and be supported by the pant 55 and sit and fix herself on the attachment 37. The pant also includes a belt 39 and a buckle 38 to further fix the person 17 at her waist, and an elastic band at each trousers leg to fix the person 17 at her thighs minimizing air leakage between the pant 55 and the person 17. When she is sitting in the pant 55 and sliding through the tube 80, a lower pressure 41 at the top of the ring shape support 79 and/or a higher pressure 42 below the ring shaped support 79 are generated, whereby her descending speed can be controlled.

In addition, the ring shaped support 79 can also include a hole 48, a valve 49 on the lower side of the ring shaped support 79, and a knob 51 connected to the valve 49 on the upper side of the ring shaped support 79. By turning the knob 51, the person 17 can adjust position of the valve 49 over the hole 48, thereby adjust the flux rate of the air in the tube 80 that flows through the hole 48, and thus control the descending acceleration/deceleration according to the person's weight.

FIG. 2B shows another embodiment of the escape device, in which the lower end of the tube 80 is closed and the upper end of the tube 80 is opened. The tube 80 further includes a second door 22 at the lower end thereof. When a person 17 attached to a disk support 79 with an attachment 37 goes through an entrance 72 at the roof floor 74 or the upper floor 75, she may then descend through the vertical tube 80. The descending motion does not change the pressure in the upper space 801, and creates a larger pressure or positive pressure in the lower space 802, and thus generates a pressure difference between the upper space 801 and the lower space 802. The pressure difference is controlled in a manner so that the disc support 79 first accelerates while traveling through the first section 82, where the holes and/or preset valves 47 are located. When the disc support 79 passes the second section 83, where the holes and/or preset valves 70 are located, the pressure difference is so controlled to provide a predetermined deceleration for the disc support 79, and thus lower the descending speed of the disc support 79 until the disc support 79 arrives to the third section 84 of the tube 80. Since there are no holes and/or preset valves in the third section 84, no air communicates between the upper and lower space 801, 802. Therefore no offset to the pressure difference is obtained therebetween. As a result, the length of the third section is configured in a way that the disc support 79 will stop when it reaches the lower floor 76 or the ground floor 77, where the person will open the door 22 to go toward the exit 32.

Figure 5A:
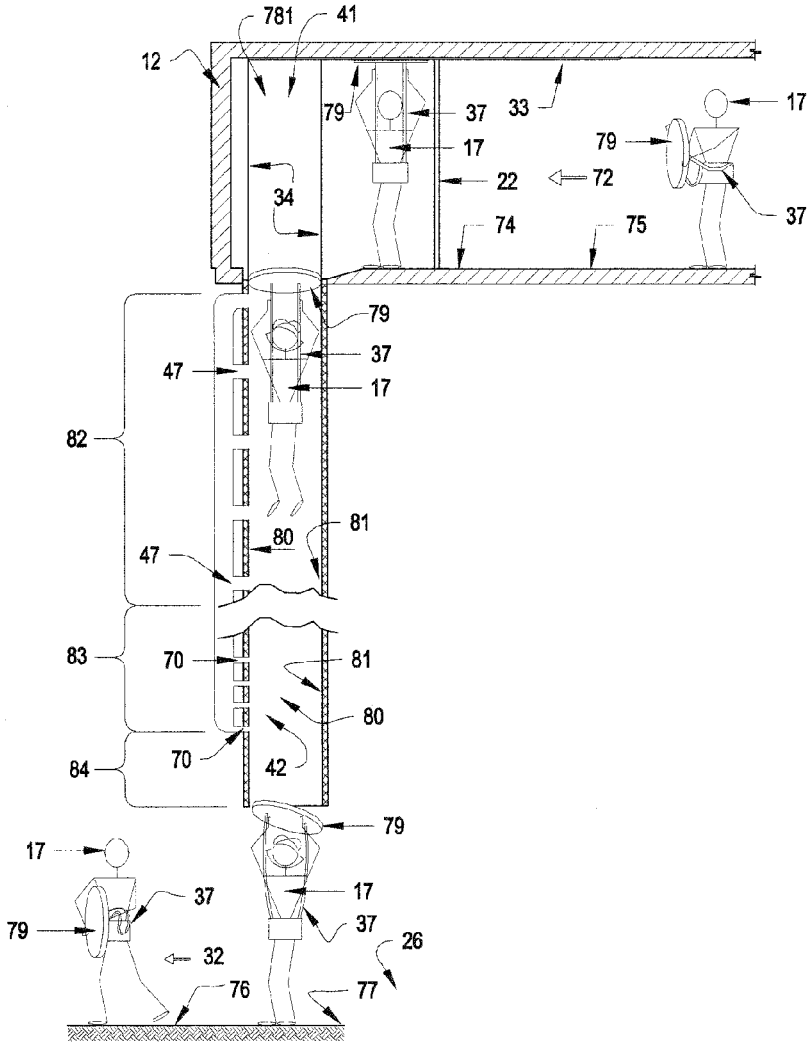
FIG. 5A shows an embodiment of a vacuum and/or negative pressure version of the escape device and a procedure of using the vacuum and/or negative pressure version of escape device.

FIG. 5A shows a procedure of escape using a vacuum version of the escape device. In this procedure, a person 17 fixed by an attachment 37 to a disk support 79 first enters into the entrance area 72 at the roof floor 74 or the upper floor 75 and then closes the door 22. Then the person 17 descends through the vertical tube 80. The descending motion creates a lower pressure 41 or vacuum above the disc support 79. The disc support 79 initially accelerates at a predetermined rate while traveling through the first section 82 (approximately 85% of the total length) where the holes and/or preset valves 47 are located. Then the disc support 79 passes the second section 83 (approximately 11% of the total length) of holes and/or preset valves 70 where a predetermined deceleration immediately starts reducing the speed of the disc support 79. At the third section 84 (approximately 4% of the total length) where there are no holes and/or preset valves, no pressure offset is obtained by the exchange of air between the upper space and the lower space. As a result, the disc support 79 will come to a stop when the person reaches the lower floor 76 or the ground floor 77 where the person will go to exit 32.

Figure 5B:
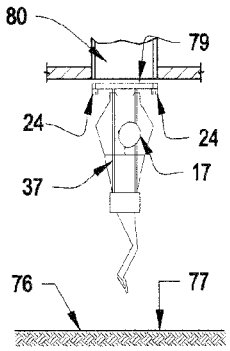
FIG. 5B and FIG. 5C show a structure of roller bearings and a procedure of using the roller bearings after sliding out of the tube.
Figure 5C:
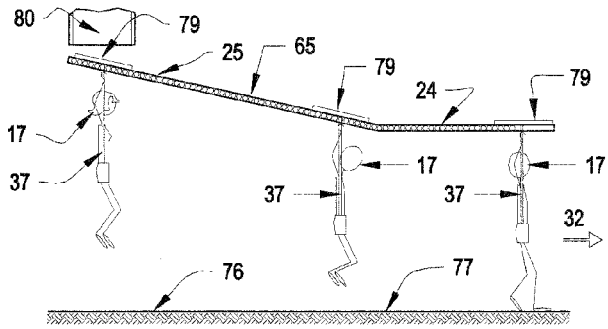

As shown in FIG. 5B and FIG. 5C, after leaving the tube 80, two inclined lateral trays 24 and roller bearings 25 are provided at the lower end of the tube 80 to receive the disc support 79. The weight of the disc support 79, together with the weight of the attachment 37 and the person 17 drives the disc support 79 laterally to the lower floor 76 or to the ground floor 77 and then to the exit 32, so that a plurality of persons can be rescued one after another in a streamlined fashion so as to increase the amount of persons being evacuated through the escape tube at a given time.

The entrance of the escape device at the higher floor may have various configurations. For example, FIGS. 15A-15F illustrate another embodiment of the entrance, the door, and the end portion for the tube 80 of the escape device as well as a procedure of preparing the descending.

Figure 15A:
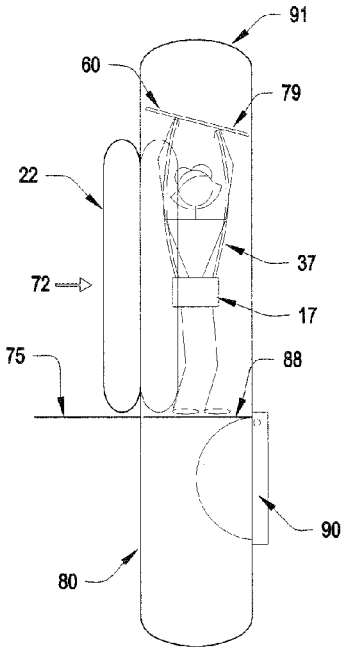
FIG. 15A shows a person enters into the tube through a door at the upper floor and stands on a plank, where the person is wearing the attachment attached to the disc support in the closed position, according to an embodiment.

As shown in FIG. 15A, the door 22 is configured to be on the wall of the tube 80. Inside the upper portion of the tube 80, there is provided an exterior compartment 90 on the wall thereof, so that an extra space is available in the wall of the tube 80. Further, the tube 80 also includes a plank 88 being hinged in the compartment 90 at the same height of the upper floor 75, so that when the plank 88 is in a horizontal position, it supports a person enters into the tube 80 from the door 22; and when the plank 88 is rotated down to a vertical position, it is completely encompassed by the space of the compartment 90. The connection between the compartment 90 and the tube 80 is perfectly sealed. Therefore, there are no air leaks in and out of the tube 80 from the compartment 90.

Figure 15B:
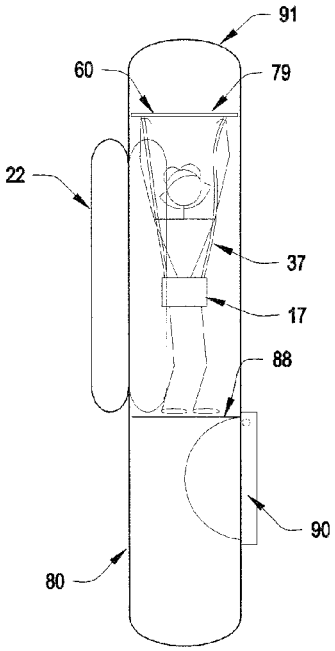
FIG. 15B shows the person with the disc support in a closed position being placed inside the dome.
Figure 15C:
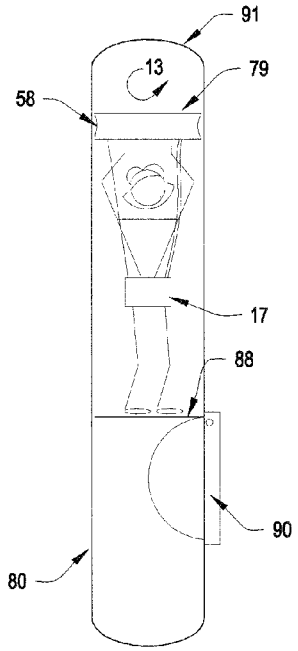
FIG. 15C shows the person with the disc support obtaining a vacuum and/or negative pressure inside a dome and the door is in a locked position.

To prepare for descending, the person 17 fixed on the attachment 37 and the disc support 79 first enters into the entrance 72 at the upper floor 75, then opens the door 22 and enters into the tube 80 and steps onto the plank 88, as shown in FIG. 15A. At this time, the disc support 79 is in the closed position 60. The person then raises the disc support 79 and fits it to the inner smooth surface of a dome 91 in the upper end of the tube 80, as shown in FIG. 15B. Next, the person closes the door 22, and pulls down the disc support 79 for a small distance to generate a predetermined negative pressure and/or vacuum pressure 13 in the dome 91 above the disc support 79. As shown in FIG. 15C, because of the interaction between the downward pulling force and the upward sucking effect of the negative pressure and/or vacuum pressure 13, the disc support 79 is now in the half closed position 58, i.e., the skirt 152 is partially deployed. The negative pressure and/or vacuum pressure is large enough to sustain the disc support 79 stay in position statically until a force sufficiently large to pull the disc support 79 downward, permitting an initial slow movement of the disc support 79 along the length of the tube 80.

Also, the negative and/or vacuum pressure 13 is directed by mechanical means to the door 22 and to the floor plank 88 in a way that the floor plank 88 will not release unless there is a vacuum 13 on the dome 91 and the door 22 is in a locked position.

Figure 15D:
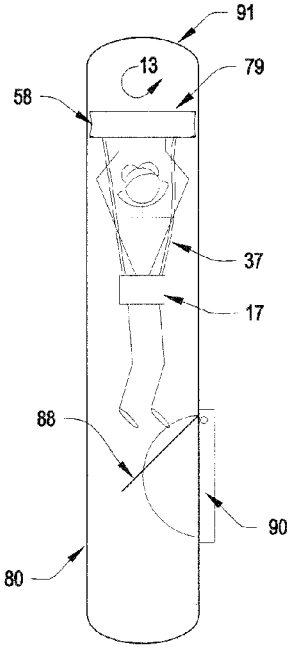
FIG. 15D shows the plank being released and the person start to descend.
Figure 15E:
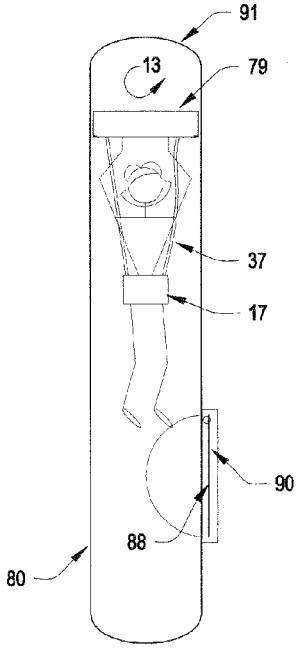
FIG. 15E shows the floor plank is totally moved out of the way from the path of the disc support and the floor plank is placed inside the exterior sealed compartment and where the person attached to the disc starts descending through the tube.
Figure 15F:
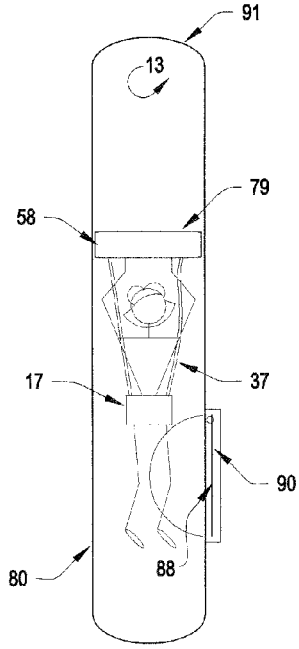
FIG. 15F shows the person attached to the attachment and the disc support continue descending through the tube.

Next, as shown in FIGS. 15D-15F, when the door 22 is locked in the closed position, the plank 88 is pivoted into the exterior sealed compartment 90, thereby completely opens the tube 80 below the person 17, releasing her to the descending motion. FIGS. 18A-18I illustrate top views and side views of the plank 88 and compartment 90, as well as how the plank 88 releases the person 17 for the descending motion.

Figure 6A:
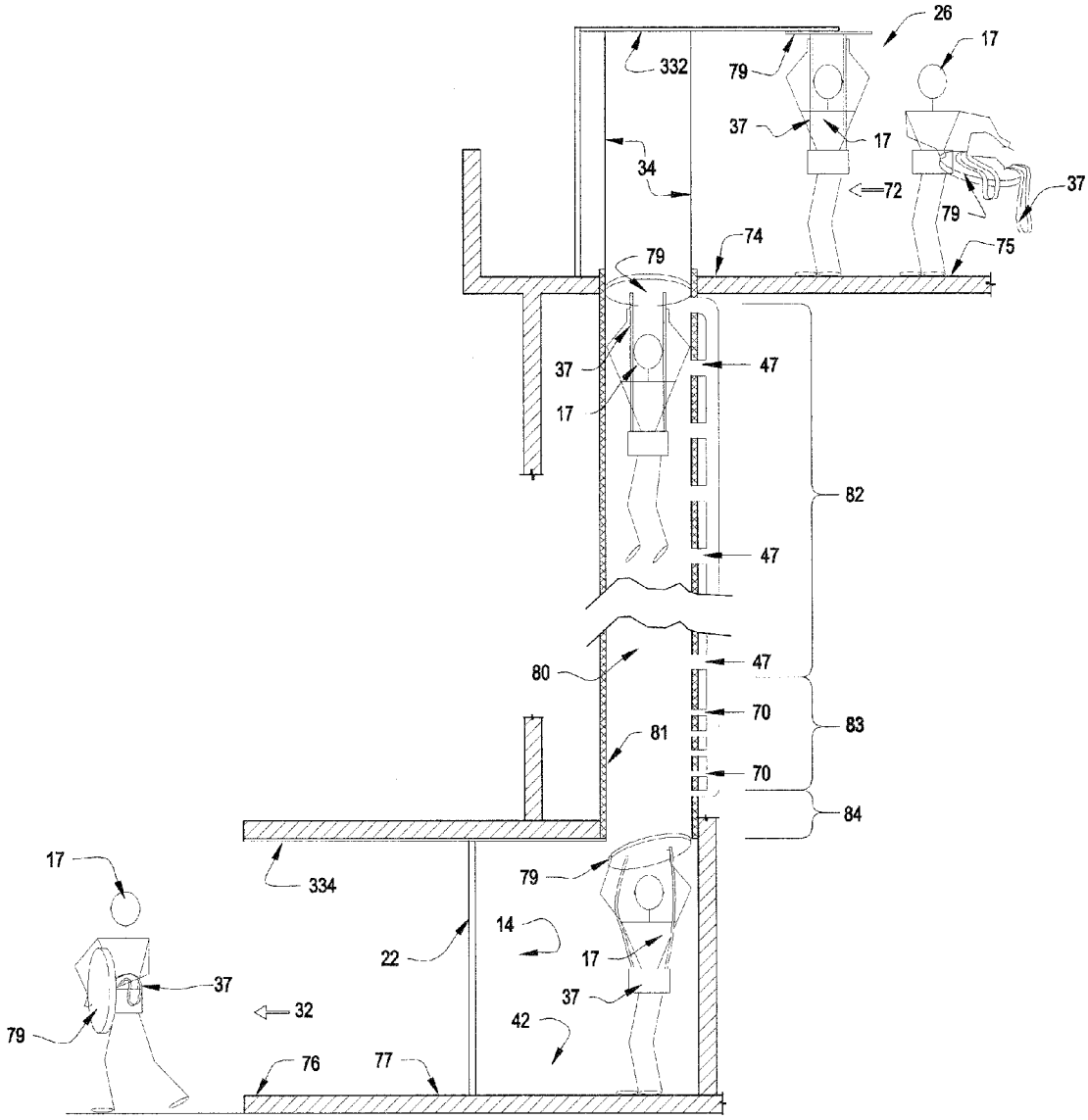
FIG. 6A shows an embodiment of a positive pressure version of the escape device and a procedure of using the positive pressure version of escape device.

Now referring to FIG. 6A. FIG. 6A shows a procedure of escape using a positive pressure version of the escape device. A person 17 first goes through the entrance 72 at the roof floor 74 or the upper floor 75, and then fixes herself to an attachment 37 and a disc support 79 guided by the rail 332. The person 17 then places herself in position for the descend through the vertical guides 34 through the tube 80. In a positive version of the escape device, the descending motion of the disc support 79 creates a higher pressure 42 or positive pressure 14 below the disc support 79 than the pressure above the disc support 79. As stated above, the disc support 79 accelerates to an optimum/predetermined speed while traveling through the first section 82 (approximately 85% of the total length), where the holes and/or preset valves 47 are located, until the disc support 79 enters into the second section 83 (approximately 11% of the total length), where the holes and/or preset valves 70 are located. When the disc support 79 enters into the second section 83, a deceleration immediately starts, bringing the disc support 79 to a lower speed until it enters into the third section 84 (approximately 4% of the total length), where no holes and/or valves are provided. Since there is no air pressure offset/released, the disc support 79 will come to a stop when the person reaches the lower floor 76 or the ground floor 77, where she will open the door 22 to go toward the exit 32.

To further increase the efficiency of evacuation, the escape device may be configured to send a plurality of persons through the tube 80 simultaneously. For example, according to another embodiment shown in FIGS. 12A-14A, the escape device includes a disc support 79 large enough for a plurality of persons and a correspondingly larger tube 80 that matches the disc support 79. On the lower side of the disc support 79, there is provided a plurality of pod slots 67, each of which is capable to hang an attachment 37 for a person. The configuration of the pod slots 67 and the corresponding portion of the attachment 37 to hook up with the pod slots 67 may be of any suitable forms. For example, each attachment 37 includes a T-shaped one-point pot clip 68. Each pod slot 67 is formed by a T-shaped groove with a cylindrical slot at one side thereof, so that an individual attachment 37 can be hooked by the T-shaped groove through the one-point pot clip 68. Once the pod clip 68 is placed into the pod slot 67 and it enters into its working position, the pod lock 69 falls back and does not release the pod clip 68 until the person arrives to the lower floor. There can also be provided a hole 48, a valve 49, and a knob 51 in the disc support 79 for additional descending control, as set forth in the previous embodiments.

As an another example, FIGS. 17A-17D shows another embodiment of the large disc support for a plurality of persons. The large disc support includes a disc 798, a lower ring 870 below the disc 798, a nonporous flexible skirt 154, and several parallel cross beams 85. The lower ring 870 has an outer diameter substantially equals to the diameter of the disc 798. the skirt 154 connects the outer peripheral of the lower ring 870 with the outer peripheral of the disc 798, so that when the lower ring moves towards/away from the disc 798, i.e., when the disc support 79 is in a closed/open position, the skirt 154 is folded/deployed. Further, each of the cross beams 85 is connected to the bottom of the disc 798 by a hinge 850, and a lever 626 interacts with the beams 85 so that when the cross beams 85 rotate towards the disc 798, the large disc support 79 is closed and when the cross beams 85 rotate away from the disc 798, the large disc support 79 is opened.

To have the pod clips 68 ready for use, the beams 85 rotate around the hinge 850 to be perpendicular to the surface of the disc 798. Accordingly, the large disc support 79 is opened and the height of which is expanded from 4 inches to a full 16 inch. Further, the pod clips 68 and the cross beams 85 are arranged to take into account the width and the size of the persons it takes and are set as to have the persons travel in a comfortable way, without having these persons touching each other at the front and back of their bodies.

Once the persons leave the disc and escape from the building, the large disc support 79 is rotated 90 degrees into the closed position and the beams too will be placed the closed position, so that the large disc support becomes 75% thinner, and thus easier for storage.

Figure 13A:
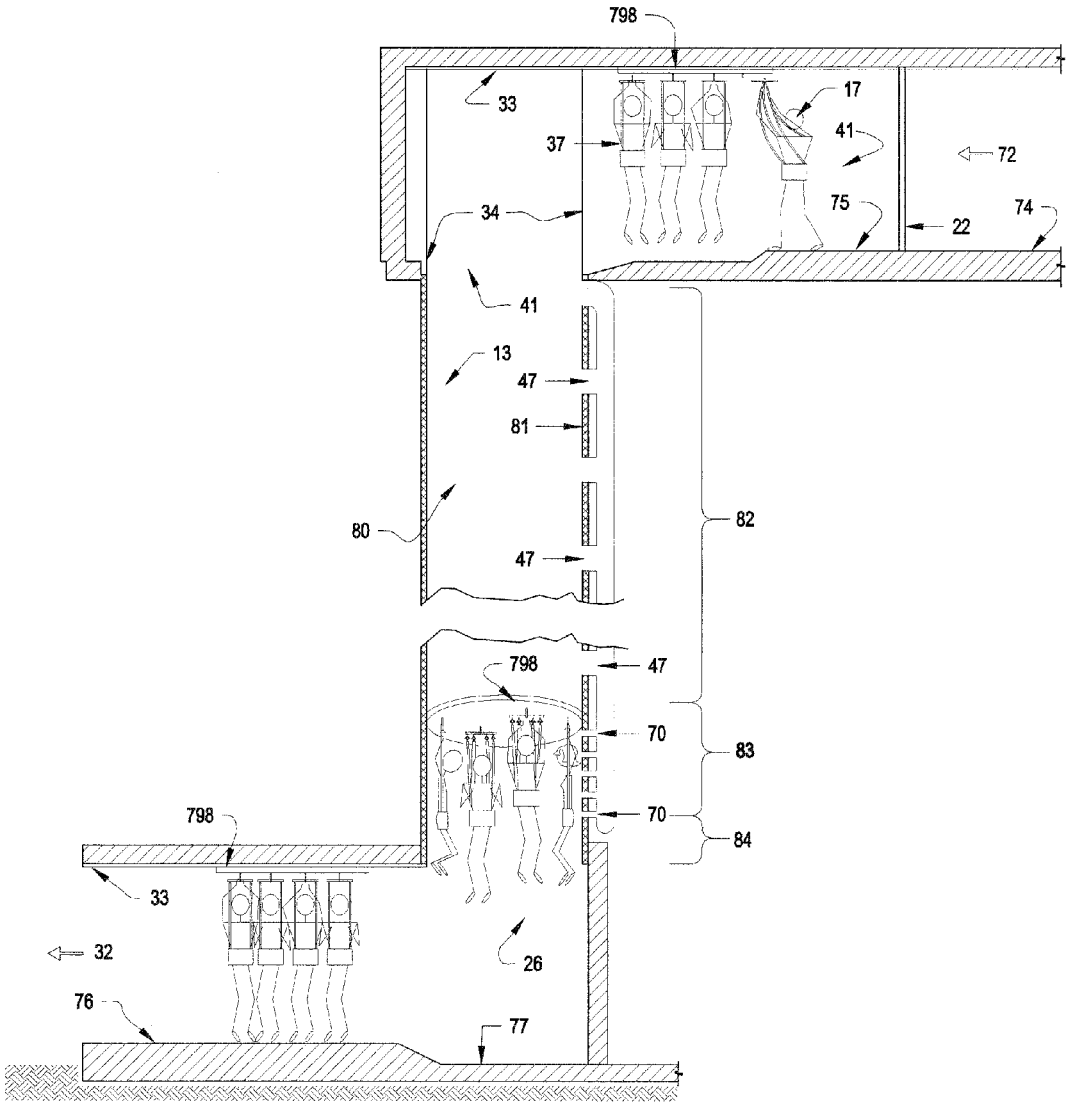
FIG. 13A shows an embodiment of negative pressure version of the escape device, where a plurality of persons can escape using the device simultaneously.

FIG. 13A shows an embodiment of negative pressure version of the rescue device using the large disc support 79. In a rescuing process, a plurality of the persons 17, connected to individual attachments 37, walk to the entrance 72 through a door 22 that will keep the lower pressure 41 or negative pressure 13 at the top of the tube 80. When all of the persons 17 are readily fixed to the disc support 79, they then place themselves in position for descending through the vertical guides 34 and descend themselves through the vertical tube 80. Because the door 22 of the upper entrance 72 is closed, the descending motion creates a lower pressure 41 or negative pressure 13 above the disc support 79. Because the lower end of the tube 80 is open, the air pressure under the disc support 79 remains atmosphere pressure. The pressure difference between the lower pressure 41 above the disc support 79 and the atmosphere pressure 26 below the disc support 79 is adjusted so that the disc support 79 initially accelerates to an optimum/predetermined speed while the disc support 79 is traveling through the first section 82 (approximately 85% of the total length), where the holes and/or preset valves 47 are located. When the disc support 79 passes the second section 83 (approximately 11% of the total length), where the holes and/or preset valves 70 are located, a deceleration immediately starts, bringing the disc support 79 to a lower speed until it reaches to the third section 84 (approximately 4% of the total length) where there are no holes and/or preset valves. Since there is no air pressure offset/released, the disc support 79 will further decelerate and eventually come to a stop when the person reaches the lower floor 76 or the ground floor 77. The person 17 then moves toward the exit 32.

Figure 14A:
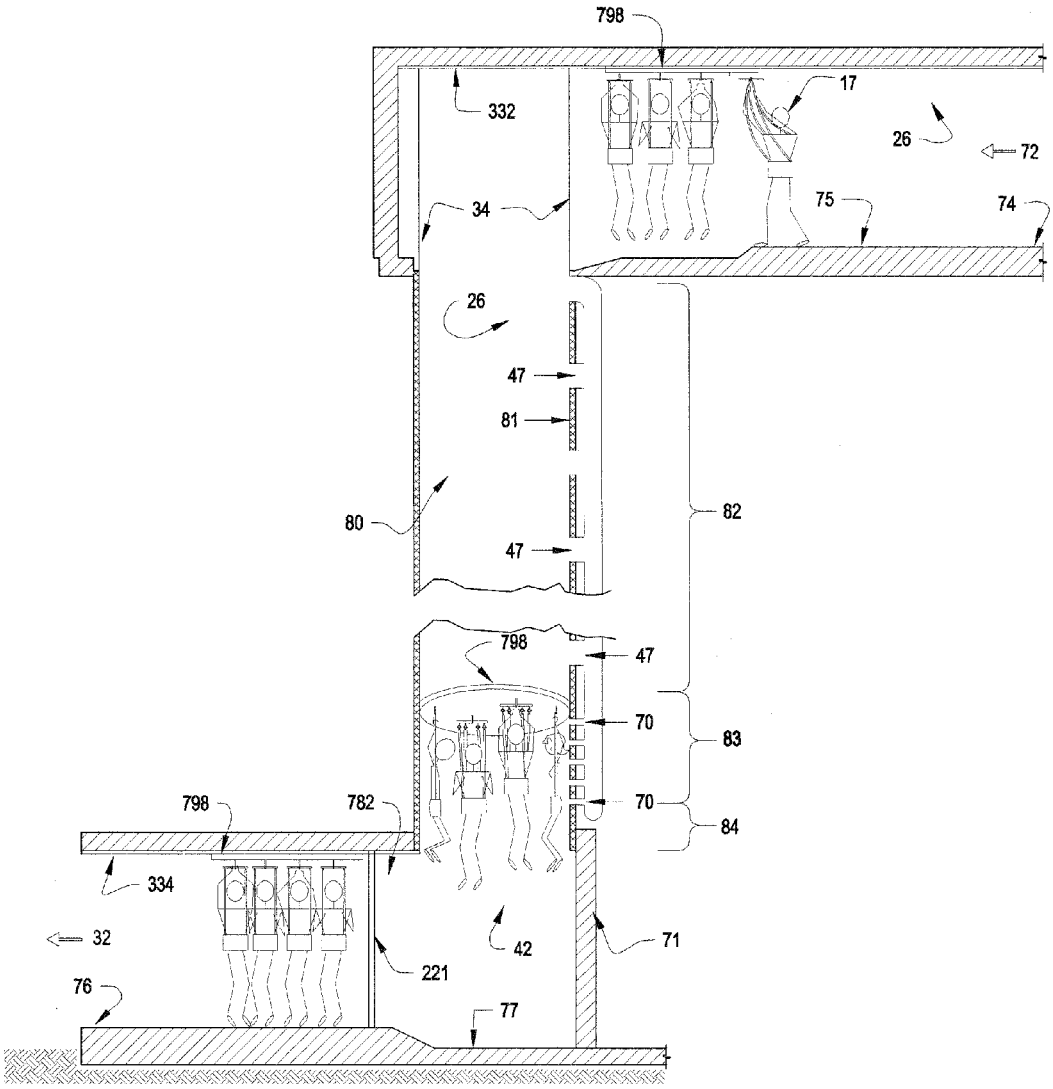
FIG. 14A shows an embodiment of positive pressure version of the escape device, where a plurality of persons can escape using the device simultaneously.

FIG. 14A shows an embodiment of positive pressure version of the escape device using the large disc support 79. When all of the persons 17 are readily fixed to the disc support 79, they then place themselves in position for descending through the vertical guides 34 and descend themselves through the vertical tube 80. Because the lower end of the tube 80 is connected to the lower chamber, and the door 22 of the lower chamber is closed, the descending motion of the disc support 79 creates a higher pressure 42 or positive pressure 14 in the tube 80 below the disc support 79. Because the entrance 72 is open to the atmosphere, the pressure above the disc support 79 remains atmosphere pressure. As set forth above, the pressure difference above and below the disc support 79 is controlled so that the disc support 79 initially experiences an acceleration until it reaches an optimum/predetermined speed while traveling through the first section (approximately 85% of the total length), where the holes and/or preset valves 47 are located. When the disc support 79 enters into the second section (approximately 11% of the total length), where the holes and/or preset valves 70 are located, a deceleration immediately starts, bringing the disc support 79 to a lower speed until it enters into the third section (approximately 4% of the total length), where there are no holes and/or preset valves. Since there is no air pressure offset/released, the disc support 79 will be further decelerated and eventually stops when the person reaches the lower floor 76 or the ground floor 77, where the person will open the door 22 to go toward the exit 32.

In addition to safely rescue persons from a higher floor to a lower floor in a building, the present invention can also be applied to send a person, such as a fireman, from a lower floor to a higher floor in a building.

Figure 7A:
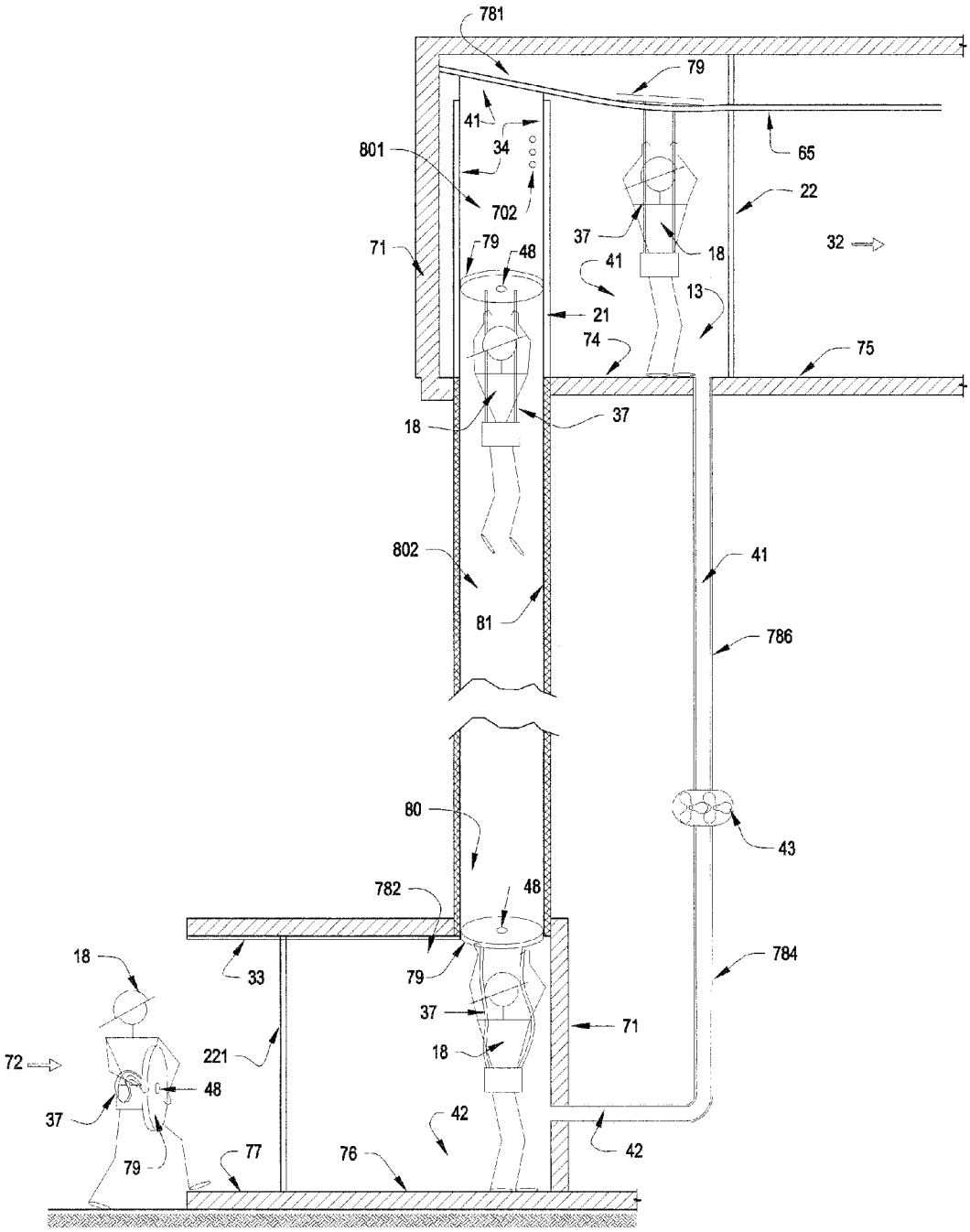
FIG. 7A shows an embodiment of a rescue device.

FIG. 7A shows an embodiment of a rescue device used to lift upward a firefighter 18 or a plurality of firefighters 18. The rescue device comprises one lower chamber 78, an upper chamber 781, a tube 80 therebetween, a disc support 79 slidable in the tube 80, and a blower 43. The blower 43 connects to the lower chamber 78 by a first channel 784 and connects to the upper chamber by a second channel 786. Operating the blower 43 generates a higher pressure 42 in the lower chamber 782 and/or a lower pressure 41 in the upper chamber 781. By using the pressure difference between the lower pressure 41 and the higher pressure 42, the fireman 18 slides upward through the tube 80 to an upper floor.

As shown on FIG. 7A, the firefighter 18 with the disc support 79 enters into the tube 80 and ascends towards the upper floor 75. At the end of the ascend when the disc support 79 reaches the section there is a plurality of holes or preset valves 702, where these holes or preset valves create a bypass between the upper and the lower sides of the disc support 79, reducing the speed of the ascend as the disc support 79 advances. Consequently, the disc support 79 stops at the height of the inclined lateral tray roller system 65, where the disc support 79 is unhooked and carried by the firefighter 18 who leaves through door 22 to continue through exit 32.

To obtain an additional control over the ascending speed, the disc support 79 may further include a hole 48 and/or a valve 49, shown in FIG. 4A, capable of adjusting the amount of air flow to adjust the upward speed of the disc support 79, taking in consideration the weight hanging below the disc support 79, i.e., closing the hole 48 will cause an increase in the upward speed and opening the hole 48 will cause a lower upward speed. It is noted that the position of the hole 48 and valve 49 may also locate in other place of the disc support 79. For example, as shown in FIG. 7A, the hole 48 and the valve 49 may locate in the center of the disc support 79.

After arriving the roof floor 74 or the higher floor 75, the disc support 79 is then engaged in the inclined lateral tray roller bearing system 65 through the guide guard 21 toward the door 22. The firefighter 18 can then enter the building through exit 32.

If necessary, this rescue device may also be used to send a person from a higher floor to a lower floor simply by decreasing the pressure difference generated by the blower 43 according to the weight of the persons 17 or firefighter 18.

Further, in addition to a rigid tube with fixed length and size, the tube in the present invention may also be foldable and flexible.

Figures 8A, 8B, 8C, 8D, 8E:
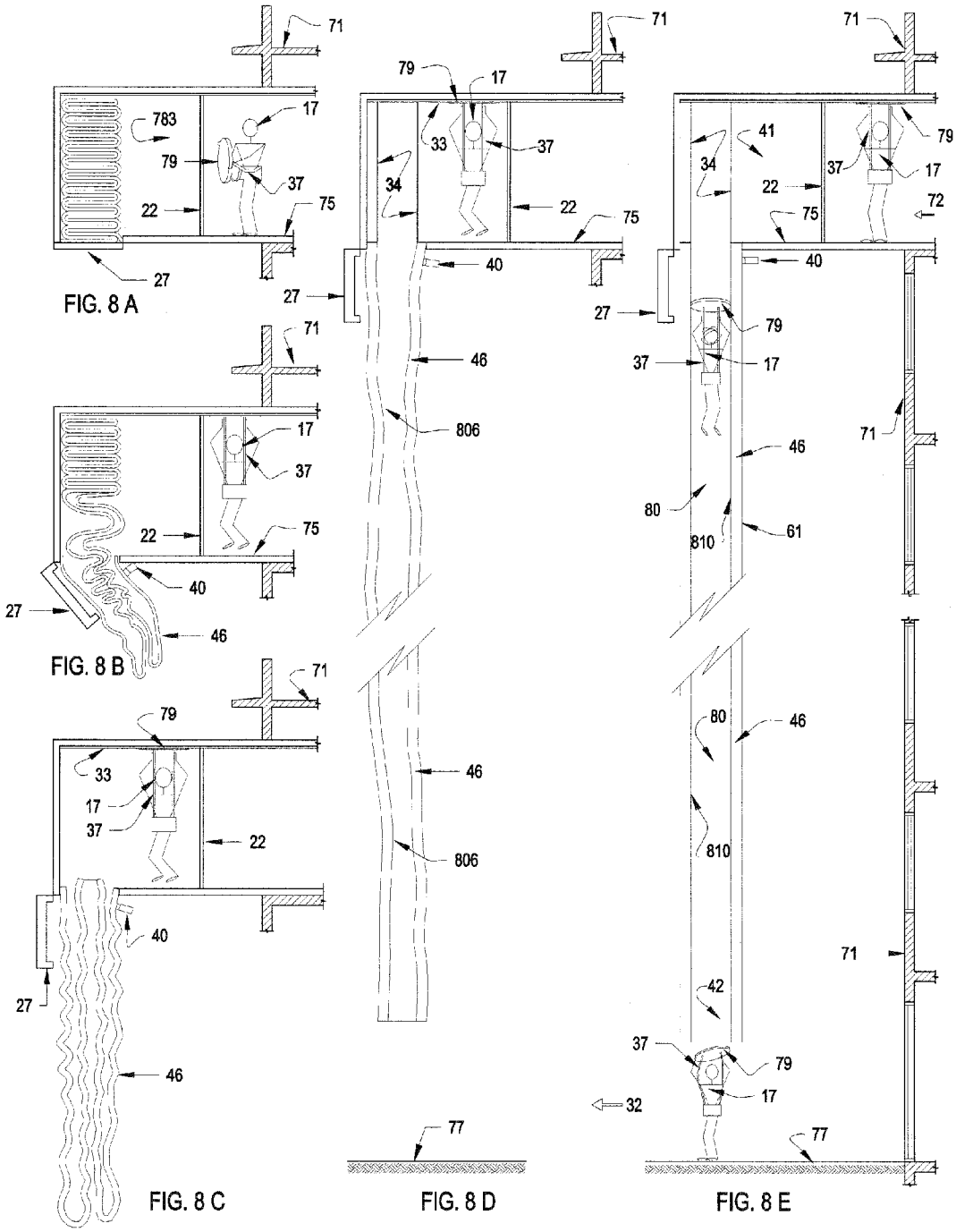
FIGS. 8A-8E shows another embodiment of the escape device where the tube is a foldable double wall duct.

FIGS. 8A-8E illustrate another embodiment of the present invention where the tube 80 is in a form of foldable double wall duct 46. FIGS. 8A-8E also chronologically illustrate a procedure when a person escapes from a building using such embodiment. As shown in FIG. 8A, the escape device includes an exterior chamber 783 attached to the building 71 and the door 22 placed at the roof floor 74 or upper floor 75. A double wall duct 46 is folded and stored in chamber 783, so that in case of an emergency, a person 17 can open the hatch 27, permitting a double wall duct 46 stored in the exterior chamber 783 to be deployed, as shown in FIG. 8B.

According to the embodiment, the double wall duct 46 is a flexible structure that can be folded and stored in a chamber. It includes an inner smooth surface 81, an outer flexible duct 61, and air inlet or valve 40 located on the upper end of the outer flexible duct 61. Both of the inner smooth surface 81 and the outer flexible duct 61 are made of a nonporous flexible material 15.

FIG. 8C shows the person 17 passes the door 22, and engages the disc support 79 to the rail 33, being ready to descend through the double wall duct 46. The double wall duct 46 in this figure. has not been fully deployed yet.

FIG. 8D shows the double wall duct 46 being fully deployed. The fully deployed double wall duct 46 reaches to approximately seven (7) feet above the ground level 77.

After double wall duct 46 is deployed, air is pumped into the space between the inner smooth surface 81 and the outer flexible duct 61 through the air inlet 40, thereby inflating the double wall duct 46 into a tube 80.

FIG. 8E shows the double wall duct 46 converted to a tube 80 and several persons 17 fixed to the attachment 37 and start to descending through the inflated double wall duct 46.

Since the door 22 is closed, the descending motion generates a lower pressure and/or vacuum pressure 41 above the disc support 79. The air pressure below the disc support 79 remains the atmospheric pressure. Therefore, the person 17 will fall controlled by the differential pressure at a safe speed through the tube 80. After the person 17 descending to the lower floor 76 or ground floor 77, she may escape through the exit 32.

FIGS. 9A-10D show another embodiment of the rescue device that may be used by firemen. According to the embodiment, a double wall conduct 46 is assembled to an extensible boom motor crane 36. As shown in FIG. 10E, the double wall conduct 46 includes at least two hooks 52 at its lower end and a plurality of rings 19 on its outer flexible duct 61. The plurality of rings 19 is distributed along the length of the double wall conduct 46 along the lower section thereof, so that when the lower section is folded, each hook 52 can hook to one of the rings 19.

Figure 10A:
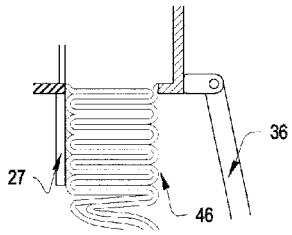
Figure 10B:
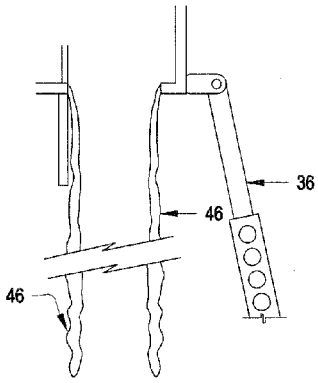
Figure 10C:
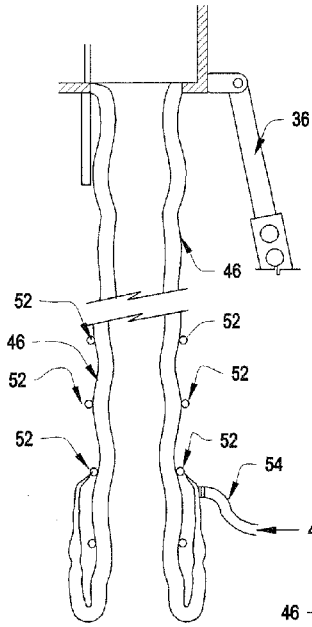

FIG. 10A shows the top end of the extensible boom motor crane 36 where the double walled duct 46 starts to be released when a hatch door 27 is opened. FIG. 10B shows the top end of the extensible boom motor crane 36 where the double walled duct 46 is deployed. When the double wall conduct 46 is longer than needed, it can be folded to a predetermined shorter length by flipping inside out the lower portion of the double wall conduct 46, i.e., section 53 a shown in FIG. 10D, to a desired length, and hooking the hook 52 to the ring 19, as shown in FIGS. 10C and 10E. Then the folded double wall conduct 46 is inflated through the inlet 40 at its lower end and forms a tube 80 with a desired length, as shown in FIG. 10D.

Figure 10D:
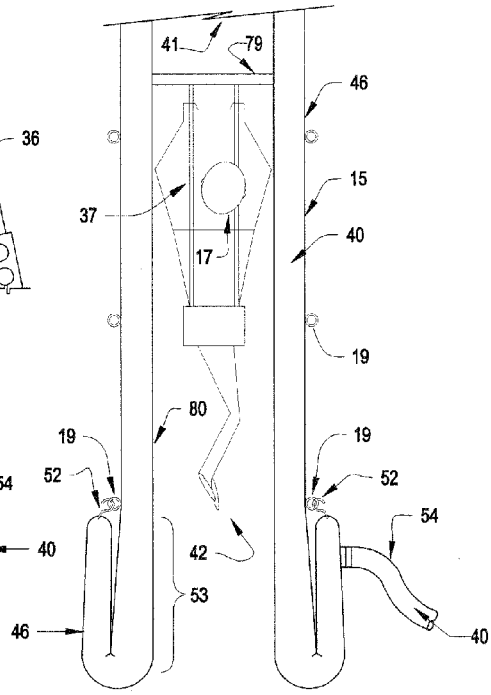
Figure 10E:
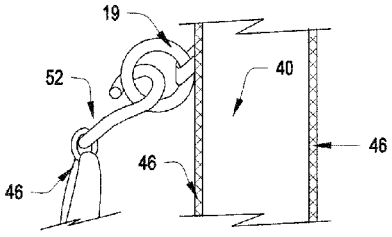
Figure 11A:
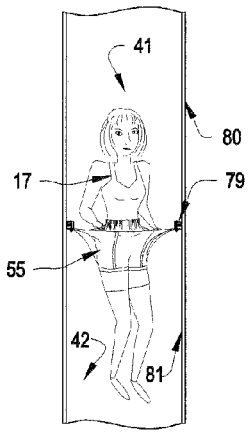
FIGS. 11A-11F shows another embodiment of the disc support.
Figure 11B:
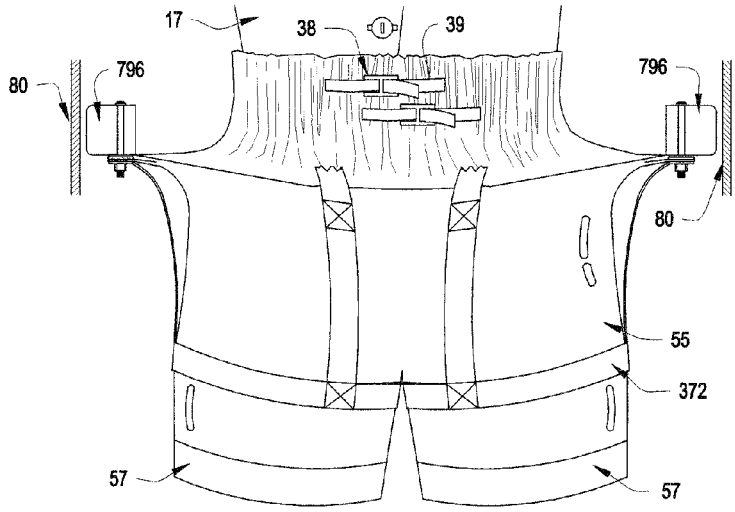
Figure 11C:
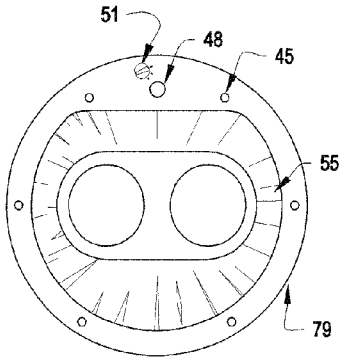
Figure 11D:
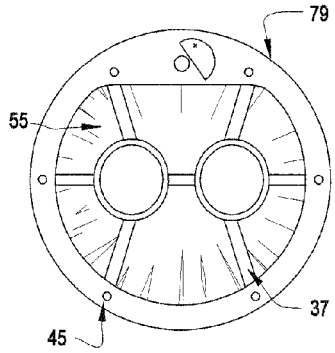
Figure 11E:
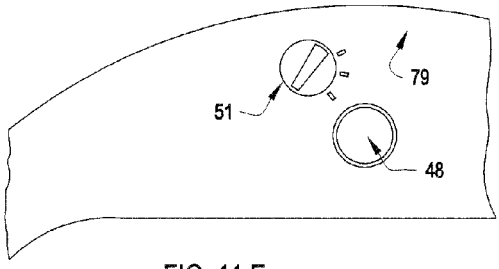
Figure 11F:
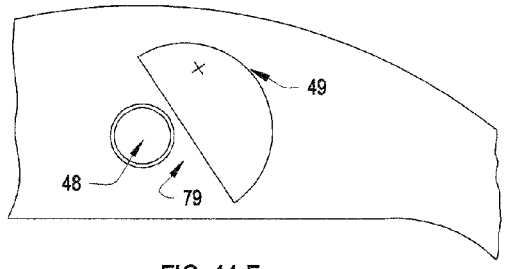
Figure 12A:
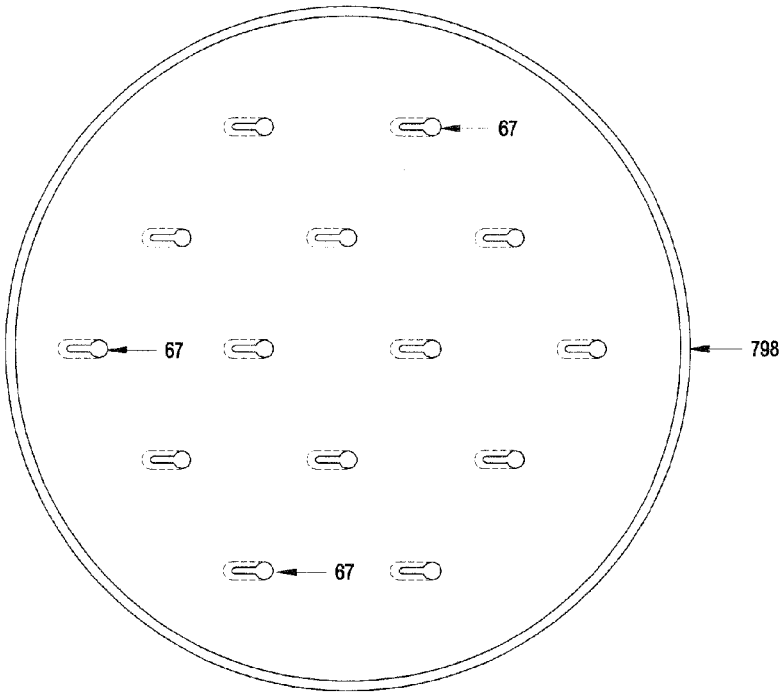
FIG. 12A shows a top view a large disc support with the pod slots.
Figure 12B:
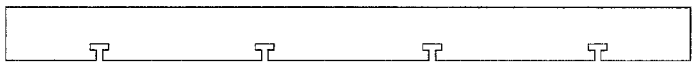
FIG. 12B shows a cross section of the large disc support.
Figure 12:
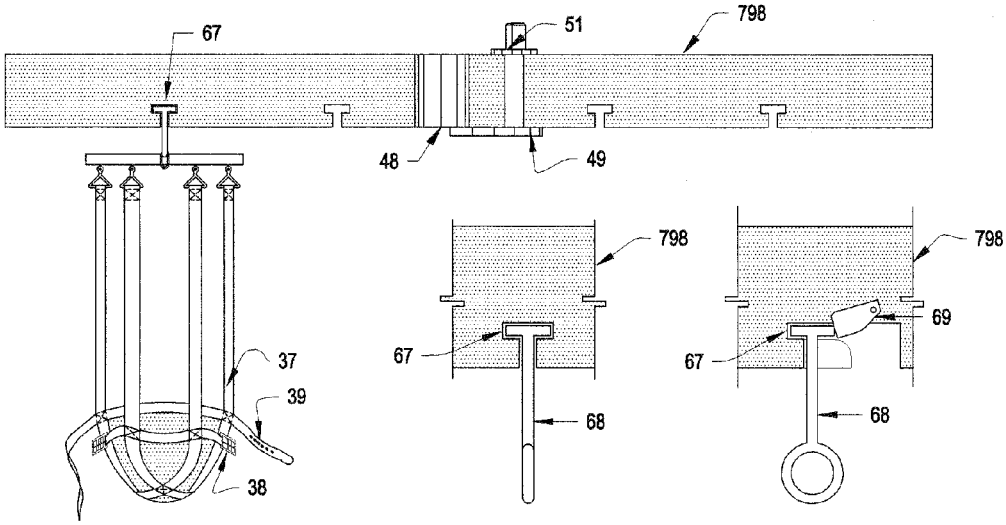
FIG. 12C shows a cross section of the large disc support showing a pod slot and the attachment with the belt and the buckle at the left side and at the center the hole and the valve attached to the knob.
FIG. 12D shows a cross section of the disc large support showing the pod clip engaged inside the disc support.
FIG. 12E shows a longitudinal section of the disc large support showing the pod clip engages inside the disc support with a clip lock in locked position.

FIG. 10D also shows the person 17 fixed to an attachment 37 and a disc support 79 is descending from the folded inflated double wall conduct 46. Because the double wall conduct 46 is folded at the section 53, the diameter at this section becomes smaller than other part of the inflated double wall conduct 46. The smaller diameter further helps decelerate the disc support 79 when it passes through the section 53.

Figure 9A:
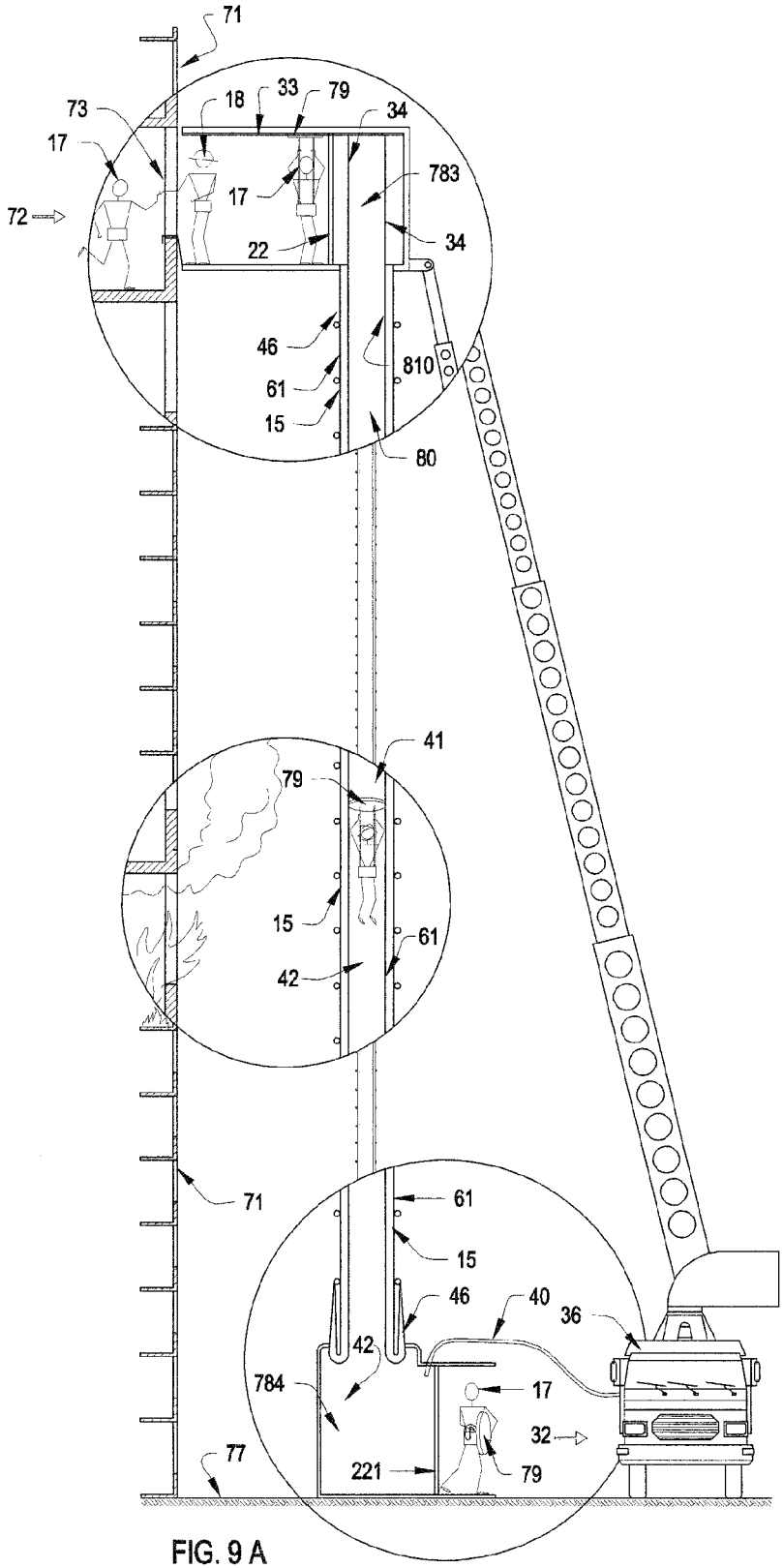

Now back to FIG. 9A, to rescue people in a building, the extensible boom motor crane 36 can rise to over one hundred twenty (120) feet high to attend a fire at a building 71 through window 73. The extensible boom motor crane 36 has an upper chamber 78 and a door 22 connected to the extensible boom, where a fireman 18 supplies disc supports 79 to as many persons 17 as needed and these persons 17 enter the upper chamber 783 through the door 22 and go down the double wall duct 46 or tube 80 at a safe and controlled speed by the lesser pressure 41 at the top side of the disc support 79 and the higher pressure 42 at the bottom of the disc support 79. The tube 80 or the inflated double wall duct 46 can extend from the window that the extensible boom motor reaches to a height of approximately seven (7) feet above the ground floor 77. Also, if needed, the lower chamber 784 can have pressurized air delivered by the extensible boom motor crane 36 to help maintain a desired pressure to control the rate of descent. When finally the persons 17 reach the ground, they can leave the escape device through door 22 and quickly move toward exit 32.

While embodiments have been particularly shown and described with reference to FIGS. 1A-18I, it will be understood by one of ordinary skill in the art that various changes in form and details may be made therein without departing from the spirit and scope of example embodiments, as defined by the following claims.

DRAWING REFERENCE NUMERALS

12. Wall
13. Vacuum Pressure and/or negative pressure
14. Positive Pressure and/or higher pressure
15. Nonporous flexible material
16. Frictionless material
17. Person or Plurality of persons
18. Fireman, Firefighter
19. Ring
20. Door frame
21. Guide guard
22. Door
24. Two lateral trays
25. Roller bearings
26. Atmospheric pressure
27. Hatch door
28. Locking system
29. Push button
30. Free position
31. Lock position
32. Exit
33. Rail
34. Guides
35. Fixing ring
36. Extensible boom motor crane
37. Attachment to fit a human body, harness, four point harness
38. Buckle
39. Belt
40. Air inlet
41. Lower pressure
42. Higher pressure
43. Blower
44. Bag
45. Eye bolt & Nut
46. Double wall duct
47. Hole, preset valve
48. Hole
49. Valve
50. Controlled air flow
51. Knob

52. Hook
53. Section where the tube is reduced in diameter
54. Hose
55. Pant
56. Hinge center
57. Elastic band
58. Open
59. Half closed
60. Closed
61. Flexible duct
62. Lever
63. Belt hook
64. Elastic material
65. Inclined lateral tray roller bearing system
67. Pod slot
68. Pod clip
69. Clip lock
70. Small Hole
70'. Hole
71. Building
72. Entrance
73. Window
74. Roof floor
75. Upper floor
76. Lower floor
77. Ground floor
78. Lower chamber
783. Upper chamber
784. First channel
79. Disc support, ring shaped support
80. Tube
81. Smooth surface
82. Acceleration length
83. Deceleration length
84. No hole and/or valve length
85. Beam
86. Intermediate ring
87. Lower ring
88. Plank
89. Swivel point
90. Exterior sealed compartment
91. Dome
152. Skirt
154. Skirt
621. Bar
622. Bar
623. Hinge
624. Hinge
626. Lever
791. Upper side
792. Lower side
793. Ring
801. Upper space
802. Lower space
850. Hinge
870. Lower ring

What is claimed is:

1. An escape device comprising:

a disc support connected to an attachment device adapted to and capable of supporting at least one human body; and a generally vertical tube having a substantially uniform cross-section along its length, an upper end and a lower end;

wherein the disc support is slidable through the vertical tube at a vertical sliding speed of the disc support which is controlled by a predetermined pressure difference between an upper part of the tube and a lower part of the tube;

wherein a first section of said vertical tube includes a plurality of valves at different openings distributed in a predetermined pattern, size, and quantity spaced along the longitudinal direction of the tube;

wherein a first section of the tube extends from a top portion to a middle portion of the tube;

wherein each opening connects the inside of the tube to the outside of said tube and is connected in parallel with other openings by an otherwise closed channel; and wherein the distribution and size of the openings are arranged in a way that the disc support has a predetermined acceleration and speed going downward to decrease the time of evacuation of the persons.

2. The escape device in claim 1 wherein the vertical tube has a second section which includes a plurality of valves at different openings distributed in a predetermined pattern, size, and quantity along a longitudinal direction of the tube;

wherein the second section of the tube extends from a middle portion to a lower portion of the tube;

wherein each opening connects the inside of the tube to the outside of said tube and is connected in parallel with other openings by the otherwise closed channel; and wherein the distribution and size of the openings are arranged in a way that the disc support would have a predetermined deceleration while going downward; and wherein the vertical tube has a third section, and where no valves or openings are provided in the third section at the lower end of the tube to offset pressure difference in the tube which would bring said disc support to a complete stop at the lower end of the tube.

3. An escape device for use with a multi-floor building comprising:

a disc support connected to an attachment device adapted to and capable of supporting at least one human body; and a generally vertical tube having a substantially uniform cross-section along its length, an upper end and a lower end;

wherein the disc support is slidable through the vertical tube at a vertical sliding speed of the disc support which is controlled by a predetermined pressure difference between an upper part of the tube and a lower open part of the tube; and wherein the lower open part of the tube has no openings or valves except the open end of the tube itself; and wherein at the top of the vertical tube there is a dome shaped volume that is pneumatically enclosed when the disc support is placed from below the dome shaped volume, sealing the dome shaped volume of the tube in a way that when the disc support is pulled downward the disc support creates a vacuum that will hold said disc support in a static position until a force sufficiently large to pull the disc support downward permitting an initial movement of said disc support along the length of the tube.

4. The escape device in claim 3, further comprising a preset valve extending through the disc support, wherein the preset valve controls the amount of air flow to vary the speed of said disc support through the tube, thereby controlling a descent of the person according to his or her weight.

5. The escape device of claim 3, further comprising: wherein the tube is a double wall duct capable of being inflated; and wherein the disc support is slidable through the inflated double wall duct, wherein a descend of said disc support generates a lower pressure at the top of the disc support.

6. The escape device in claim 5, wherein the double wall duct can be concealed in a storage compartment at an upper floor of the multi-floor building unit and is capable of being deployed and released from a lower end of the storage compartment thereof.

7. The escape device in claim 5, wherein the top end of the double wall duct is fixed to an extensible boom motor crane that is configured to reach to a side of a building and can be secured to a window on said building, wherein the double wall duct is configured that when it is folded inside out at the lower end to a predetermined shorter length, the double wall duct is capable to remain a folded configuration after being inflated into a tube so that the double wall duct remains the shortened length.

8. The escape device in claim 7, further comprising a chamber attached to the lower end of the double wall duct, wherein by means of a regulated blower or an exterior regulated pressure blowing into the chamber the disc support is lowered to safety into the chamber.

9. An escape device in claim 3, wherein the disc support is a ring shaped support connected to a sealed pant device capable of supporting at least one human body.

10. The escape device in claim 3 wherein said disc support includes at least two planar surfaces connected to and facing one another, wherein when the disc support slides through the tube, the planner surfaces at all times maintain substantially perpendicular to a longitudinal axis of the vertical tube thus avoiding a turn over of the disc support and at the same time prevent a substantial air pressure loss that occurs between edges of the disc support and an interior surface of the tube, thus allowing a controlled sliding motion of said disc support.

11. The escape device in claim 3, wherein at an entrance to the tube there is a floor plank hinged in the vertical tube, wherein the plank is capable to support a person when it is in a horizontal position;

wherein said plank has a collapsing mechanism, so that when the plank is in a vertical position, it does not interfere the sliding motion of the disk.

* * * * *